US011264711B2

(12) United States Patent
Shamblin

(10) Patent No.: US 11,264,711 B2
(45) Date of Patent: Mar. 1, 2022

(54) MICROSTRIP ANTENNA ASSEMBLY HAVING A DETUNING RESISTANT AND ELECTRICALLY SMALL GROUND PLANE

(71) Applicant: AVX Antenna, Inc., San Diego, CA (US)

(72) Inventor: John Shamblin, San Diego, CA (US)

(73) Assignee: AVX Antenna, Inc., San Diego, CA (US)

( * ) Notice: Subject to any disclaimer, the term of this patent is extended or adjusted under 35 U.S.C. 154(b) by 0 days.

(21) Appl. No.: 16/851,559

(22) Filed: Apr. 17, 2020

(65) Prior Publication Data

US 2020/0243963 A1 Jul. 30, 2020

Related U.S. Application Data

(63) Continuation of application No. 16/058,585, filed on Aug. 8, 2018, now Pat. No. 10,629,987.

(60) Provisional application No. 62/579,862, filed on Oct. 31, 2017.

(51) Int. Cl.

| | |
|---|---|
| ***H01Q 1/48*** | (2006.01) |
| ***H01Q 9/04*** | (2006.01) |
| ***H01Q 5/378*** | (2015.01) |
| ***H01Q 19/00*** | (2006.01) |

(52) U.S. Cl.

CPC ..... *H01Q 1/48* (2013.01); *H01Q 5/378* (2015.01); *H01Q 9/0407* (2013.01); *H01Q 9/0421* (2013.01); *H01Q 19/005* (2013.01)

(58) Field of Classification Search

CPC ..... H01Q 1/48; H01Q 5/378; H01Q 5/385; H01Q 5/392; H01Q 9/0407; H01Q 9/0414; H01Q 9/0421

See application file for complete search history.

(56) References Cited

U.S. PATENT DOCUMENTS

| | | | | |
|---|---|---|---|---|
| 6,008,764 | A | 12/1999 | Ollikainen | |
| 6,181,281 | B1 | 1/2001 | Desclos et al. | |
| 6,323,810 | B1 | 11/2001 | Poilasne et al. | |
| 7,629,930 | B2 | 12/2009 | Murch et al. | |
| 10,629,987 | B2 * | 4/2020 | Shamblin | H01Q 5/378 |
| 2008/0074332 | A1 | 3/2008 | Arronte | |

* cited by examiner

*Primary Examiner* — Robert Karacsony
(74) *Attorney, Agent, or Firm* — Dority & Manning, P.A.

(57) ABSTRACT

An antenna assembly is disclosed including a ground plane having a first longitudinal edge and a second longitudinal edge. The first and second longitudinal edges may extend in a longitudinal direction and may be spaced apart in a lateral direction that is perpendicular to the longitudinal direction. The ground plane may define a first plurality of slots that are open to the first longitudinal edge and a second plurality of slots that are open to the second longitudinal edge. The antenna assembly may also include a patch antenna spaced apart from the ground plane and arranged in parallel with the ground plane. The patch antenna may have a pair of opposite edges and may define a first plurality of slots that are open to one of the pair of opposite edges of the patch antenna. In some embodiments, the antenna assembly may include one or more parasitic elements that also define a plurality of slots.

19 Claims, 16 Drawing Sheets

MICROSTRIP ANTENNA ASSEMBLY HAVING A DETUNING RESISTANT AND ELECTRICALLY SMALL GROUND PLANE

PRIORITY CLAIM

The present application is a continuation of U.S. application Ser. No. 16/058,585, titled "Microstrip Antenna Assembly Having a Detuning Resistant and Electrically Small Ground Plane," filed Aug. 8, 2018, which claims the benefit of priority of U.S. Provisional Patent Application Ser. No. 62/579,862, titled "Antenna with Slotted Conductors," filed Oct. 31, 2017, which is incorporated herein by reference.

FIELD

Example aspects of the present disclosure relate generally to radio antenna design, for instance, for point-to-point radio links, radiofrequency identification (RFID) applications, and local area networks (LAN).

BACKGROUND

With classical antenna structures, a certain physical volume is required to produce a resonant antenna structure at a particular radio frequency for a specific bandwidth. Much work has been done over time to develop techniques that effectively reduce the antenna size while maintaining performance. As the physical size of an antenna is reduced, the peak gain decreases and the beam width of the radiation pattern increases, thus resulting in a wide beam width low directivity antenna. It tends to be more difficult to control the radiation pattern characteristics of electrically small antennas.

A common antenna type is a microstrip antenna, which is a low profile planar antenna element that can be placed above and close to a ground plane. The ground plane is integral to the antenna and can be on the order of a wavelength for proper operation. As the ground plane increases in size the front-to-back ratio of the radiation pattern increases, resulting in a more optimized antenna when radiation in the forward sector is desired. The increase in ground plane size, however, can be a negative attribute when overall antenna size and cost are considered. The microstrip antenna can be designed with a smaller ground plane at the expense of front-to-back ratio.

Additionally, frequency de-tuning can occur when a microstrip antenna with an undersized ground plane is placed on a larger ground plane. The frequency response of the antenna may shift because of the larger ground plane provides increased structure for coupling. This de-tuning is a common problem due to the desire to design a single microstrip antenna that can be used for multiple applications where there are different ground planes or mounting structures used in the multiple applications.

SUMMARY

Aspects and advantages of embodiments of the present disclosure will be set forth in part in the following description, or may be learned from the description, or may be learned through practice of the embodiments.

One example aspect of the present disclosure is directed to an antenna assembly including a ground plane having a first longitudinal edge and a second longitudinal edge. The first and second longitudinal edges may extend in a longitudinal direction and may be spaced apart in a lateral direction that is perpendicular to the longitudinal direction. The ground plane may define a first plurality of slots that are open to the first longitudinal edge and a second plurality of slots that are open to the second longitudinal edge. The antenna assembly may also include a patch antenna spaced apart from the ground plane and arranged in parallel with the ground plane. The patch antenna may have a pair of opposite edges and may define a first plurality of slots that are open to one of the pair of opposite edges of the patch antenna.

These and other features, aspects, and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

Figure 1A:
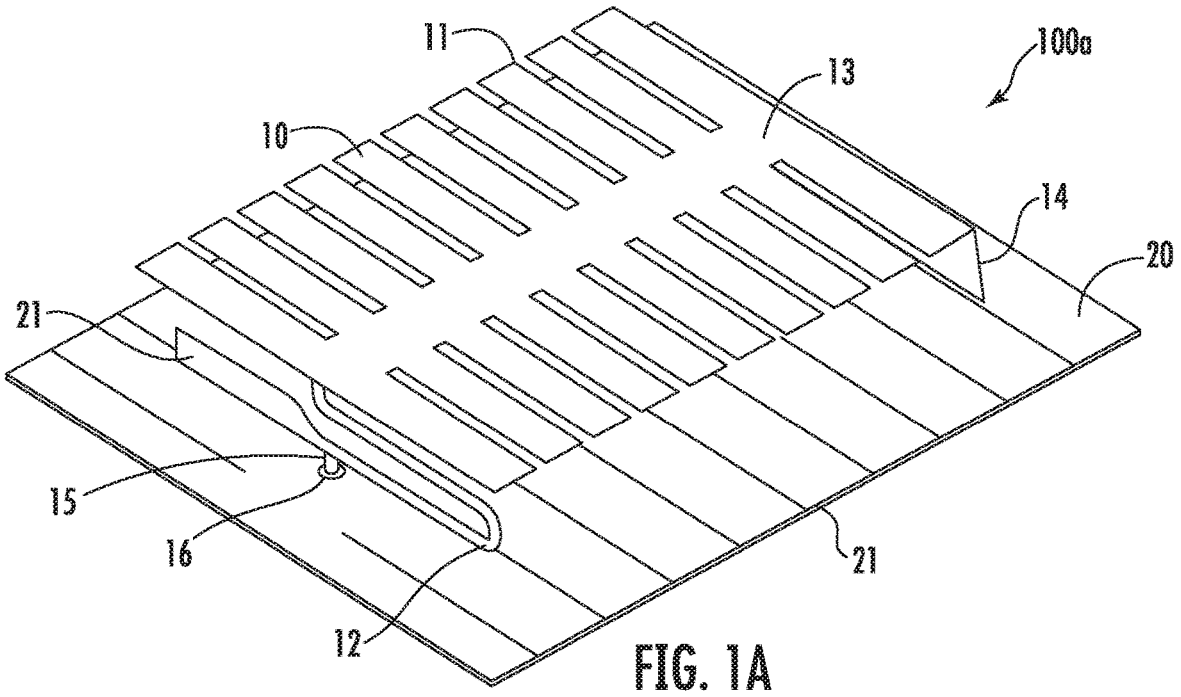
FIG. 1A shows an electrically small patch antenna positioned above an electrically small ground plane having slots therein according to example aspects of the present disclosure.

Repeat use of reference characters in the present specification and drawings is intended to represent same or analogous features or elements of the invention.

DETAILED DESCRIPTION

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to an antenna assembly. The antenna assembly can include a ground plane having a plurality of slots and a patch antenna spaced apart and arranged in parallel with the ground plane. The configuration of the antenna assembly can reduce de-tuning. For example, the ground plane with slots can act as a larger ground plane, which can prevent or reduce de-tuning when the antenna assembly is placed near a large structure that also acts as a ground plane. The antenna assembly may also provide a larger front-to-back ratio, thus allowing better control over the directionality of the antenna. Additionally, the antenna assembly may provide the ability to change polarization properties of the antenna without increasing antenna size.

In some embodiments, the antenna assembly may include a parasitic element spaced apart from the patch antenna and arranged in parallel with the patch antenna. The parasitic element may also define a plurality of slots that are open to an edge of the parasitic element. The parasitic element may provide an additional resonance of the antenna, and the slots of the parasitic element may help reduce the size of the antenna assembly.

One example aspect of the present disclosure is directed to an antenna assembly including a ground plane having a first longitudinal edge and a second longitudinal edge. The first and second longitudinal edges may extend in a longitudinal direction and may be spaced apart in a lateral direction that is perpendicular to the longitudinal direction. The ground plane may define a first plurality of slots that are open to the first longitudinal edge and a second plurality of slots that are open to the second longitudinal edge. The antenna assembly may also include a patch antenna spaced apart from the ground plane and arranged in parallel with the ground plane. The patch antenna may have a pair of opposite edges and may define a first plurality of slots that are open to one of the pair of opposite edges of the patch antenna.

In some embodiments, at least one of the first plurality of slots or the second plurality of slots of the ground plane may be evenly spaced apart.

In some embodiments, the slots of the first plurality of slots of the ground plane may be arranged in parallel with each other and elongated in the lateral direction.

In some embodiments, each of the slots of the first plurality of slots of the ground plane and each of the slots of the second plurality of slots of the ground plane may be elongated in the lateral direction and arranged in parallel with each other.

In some embodiments, each of the first plurality of slots of the ground plane may have a pair of parallel, straight edges that defines a uniform width along a length of the slot.

In some embodiments, the slots of the first plurality of slots of the ground plane may be parallel with each other and elongated in a first direction. The slots of the second plurality of slots of the ground plane may be parallel with each other and elongated in a second direction. An angle may be formed between the first direction and the second direction that is greater than 0 degrees.

In some embodiments, the pair of opposite edges of the patch antenna may be parallel with the longitudinal edges of the ground plane.

In some embodiments, the patch antenna may define a second plurality of slots that are open to the other of the pair of opposite edges of the patch antenna.

In some embodiments, the slots of the first plurality of slots of the patch antenna may be parallel with each other and elongated in a first direction. The slots of the second plurality of slots of the patch antenna may be parallel with each other and elongated in a second direction. An angle may be formed between the first direction and the second direction that is greater than 0 degrees.

In some embodiments, the slots of the first plurality of slots of the patch antenna may be parallel with at least one of the first plurality of slots of the ground plane or the second plurality of slots of the ground plane.

In some embodiments, the pair of opposite edges of the patch antenna may be aligned with the lateral direction. The first plurality of slots of the patch antenna may have a convex tapered configuration such that respective lengths of the first plurality of slots of the patch antenna decrease from the opposite edges towards a middle of the patch antenna with respect to the longitudinal direction.

In some embodiments, the pair of opposite edges of the patch antenna may be aligned with the lateral direction. The first plurality of slots of the patch antenna may have a concave tapered configuration such that respective lengths of the first plurality of slots of the patch antenna increase from the opposite edges towards a middle of the patch antenna with respect to the longitudinal direction.

In some embodiments, the patch antenna may have a feed end, and the patch antenna may include an electrical connection extending towards the ground plane from the feed end. In some embodiments, the patch antenna may have a non-feed end opposite the feed end, and the non-feed end may be free of connection with the ground plane.

In some embodiments, the first plurality of slots of the patch antenna may have a tapered configuration such that respective lengths of the first plurality of slots of the patch antenna decrease from the feed end to the non-feed end.

In some embodiments, the first plurality of slots of the patch antenna may have a tapered configuration such that respective lengths of the first plurality of slots of the patch antenna increase from the feed end to the non-feed end.

In some embodiments, the antenna assembly may further include a parasitic element that is spaced apart from the patch antenna and parallel with the patch antenna. The parasitic element may have an edge and may define a plurality of slots that are open to the edge of the parasitic element.

In some embodiments, the parasitic element may have a pair of opposite edges that are parallel with the longitudinal edges of the ground plane. The parasitic element may define a first plurality of slots that are open to one of the pair of opposite edges of the parasitic element and may define a second plurality of slots that are open to the other of the pair of opposite edges of the parasitic element.

Another example aspect of the present disclosure is directed to an antenna assembly including a ground plane having a rectangular shape having a first longitudinal edge and a second longitudinal edge. The first and second longitudinal edges may extend in a longitudinal direction and may be spaced apart in a lateral direction that is perpendicular to the longitudinal direction. The rectangular shape of the antenna assembly may have a first lateral edge and a second lateral edge. The first and second lateral edges may extend in the lateral direction between the longitudinal edges. The ground plane may define a first plurality of slots that are open to the first longitudinal edge and a second plurality of slots that are open to the second longitudinal edge. The antenna assembly may also include a patch antenna that is spaced apart from the ground plane and arranged in parallel with the ground plane. The patch antenna may have a rectangular shape having a pair of longitudinal edges that are parallel with the first and second longitudinal edges of the ground plane. The patch antenna may define a first plurality of slots that are open to one of the pair of longitudinal edges of the patch antenna and a second plurality of slots that are open to the other of the pair of longitudinal edges of the patch antenna.

FIG. 1A shows an antenna assembly 100*a* including an electrically small patch antenna 10 positioned above an electrically small ground plane 20. Each of the patch 10 and the ground plane 20 may define slots therein, wherein the slots embedded in the patch 10 are referred to as "patch slots 11" and the slots embedded in the ground plane 20 are referred to as "ground plane slots 21." In some embodiments, the patch may comprise a first vertical portion 12 extending vertically relative to the ground plane 20, a horizontal portion 13 extending parallel to the ground plane 20, and a second vertical portion 14 extending from a distal end of the patch in a vertical orientation toward the direction of the ground plane. The first vertical portion may be generally soldered to a feed 15 at a solder point 16.

The patch slots may be evenly spaced along two sides of the horizontal portion of the patch conductor. The width and depth of slots can be varied to change the impact of tuning on the antenna conductor. The ground plane slots may be evenly spaced along two sides of the ground plane conductor, the two sides of the ground plane conductor containing the ground plane slots may be in alignment with the two sides of the patch conductor, which contain the patch slots.

It should be noted that the slots (patch slots and/or ground plane slots) may be independently spaced and not evenly spaced. Further, slots can be designed in any position, width, depth or other design configuration as desired to achieve the desired effect.

Figure 1B:
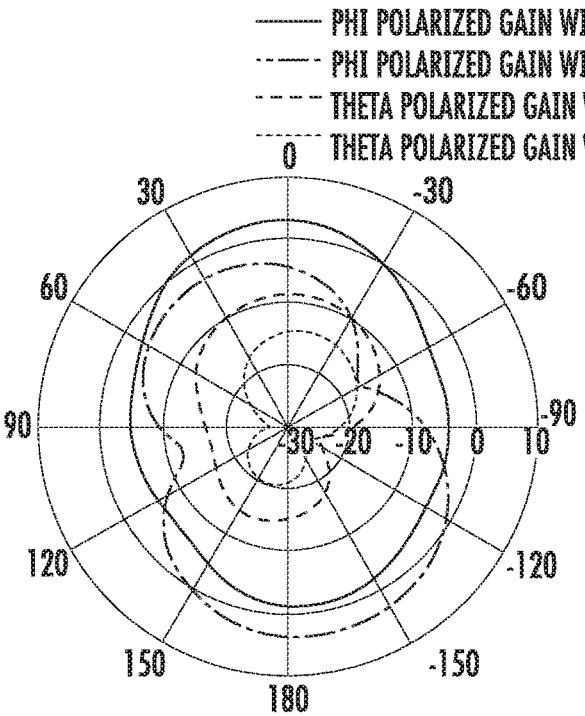
FIG. 1B illustrates polarized gain, with and without ground slots, with respect to the X-Z planar cut of the radiation pattern associated with the antenna of FIG. 1A according to example aspects of the present disclosure.

FIG. 1B illustrates polarized gain, with and without ground slots, with respect to the X-Z planar cut of the radiation pattern associated with the antenna of FIG. 1A.

Figure 1C:
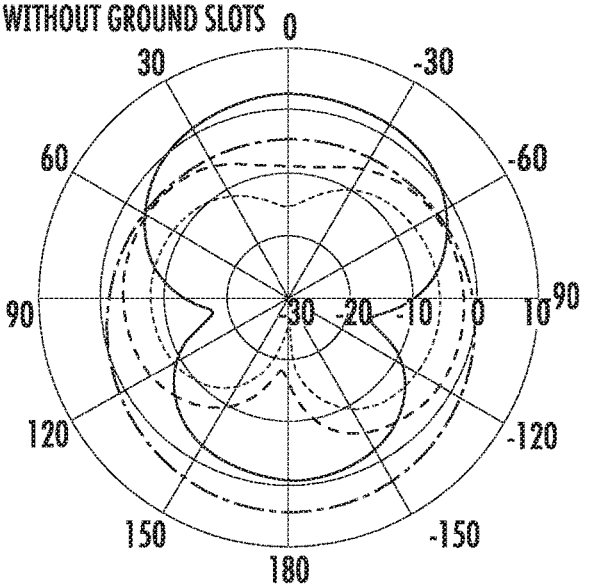
FIG. 1C illustrates polarized gain, with and without ground slots, with respect to the Y-Z planar cut of the radiation pattern associated with the antenna of FIG. 1A according to example aspects of the present disclosure.

FIG. 1C illustrates polarized gain, with and without ground slots, with respect to the Y-Z planar cut of the radiation pattern associated with the antenna of FIG. 1A.

Figure 2A:
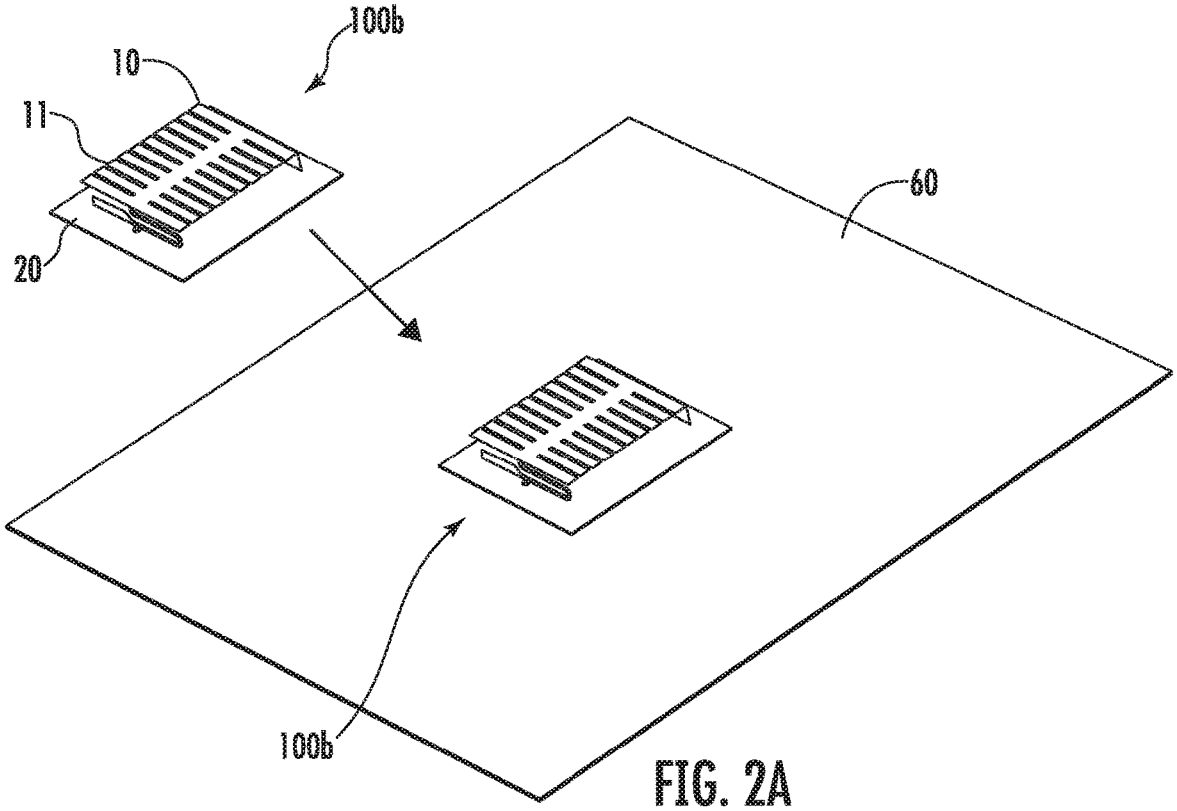
FIG. 2A shows an antenna assembly including an electrically small patch antenna with a small ground plane being positioned in free space, and further showing the antenna assembly positioned over a large ground plane according to example aspects of the present disclosure.

It should be noted that the antenna patch with slots being positioned above a ground plane without slots is illustrated in FIG. 2A. Also, it was surprisingly discovered that gain is increased for the antenna assembly having an electrically small ground plane with slots.

FIG. 2A shows an antenna assembly 100*b* including an electrically small patch antenna 10 with a small ground plane 20 being positioned in free space, and further showing the antenna assembly 100*b* positioned over a large ground plane 60. Here, the patch 10 comprises slots 11 as shown in FIG. 1A. The antenna assembly 100*b* is further positioned above a relatively large ground plane 60 (at least twice the size of the small ground plane) which can be referred to as a "second ground plane" herein.

Figure 2B:
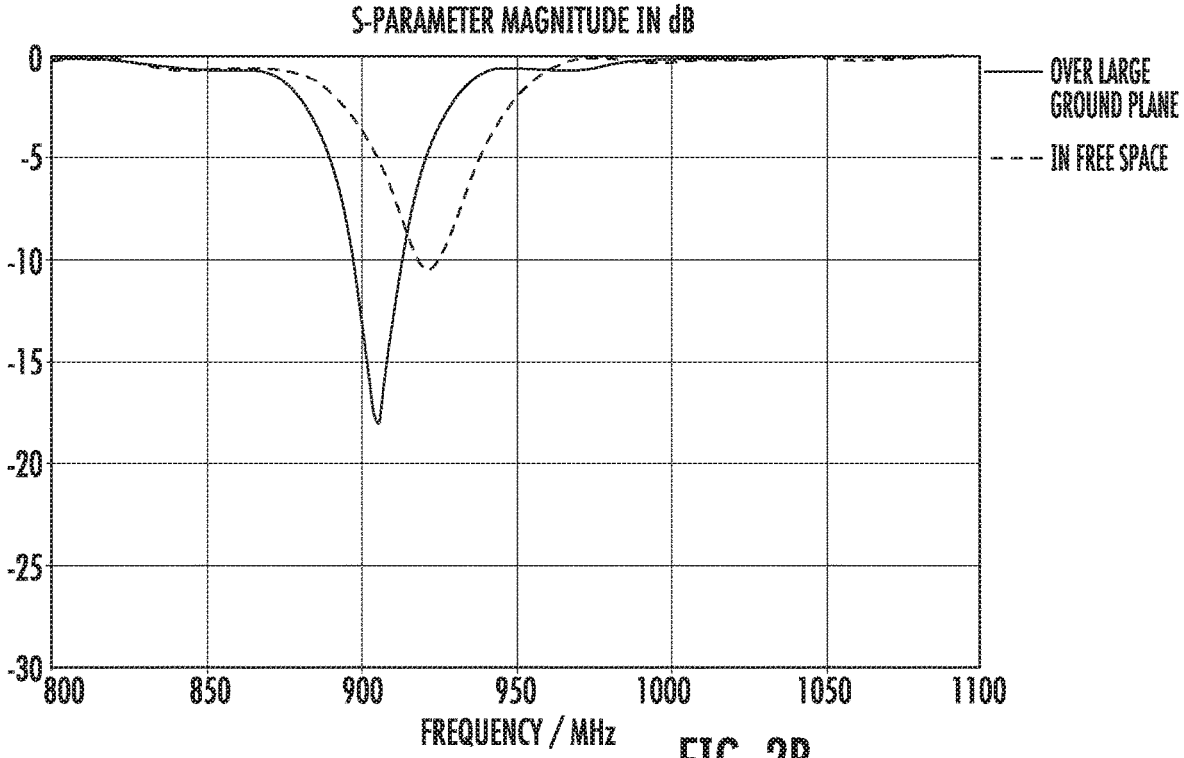
FIG. 2B shows a plot of return loss of the antenna assembly of FIG. 2A being positioned both in free space and also with the antenna assembly positioned over the large ground plane, wherein significant de-tuning and frequency shift is observed according to example aspects of the present disclosure.

FIG. 2B shows a plot of return loss of the antenna assembly 100*b* of FIG. 2A being positioned both in free space and also with the antenna assembly positioned over the large ground plane 60, wherein significant de-tuning (degradation of return loss in-band) and frequency shift are observed.

Figure 3A:
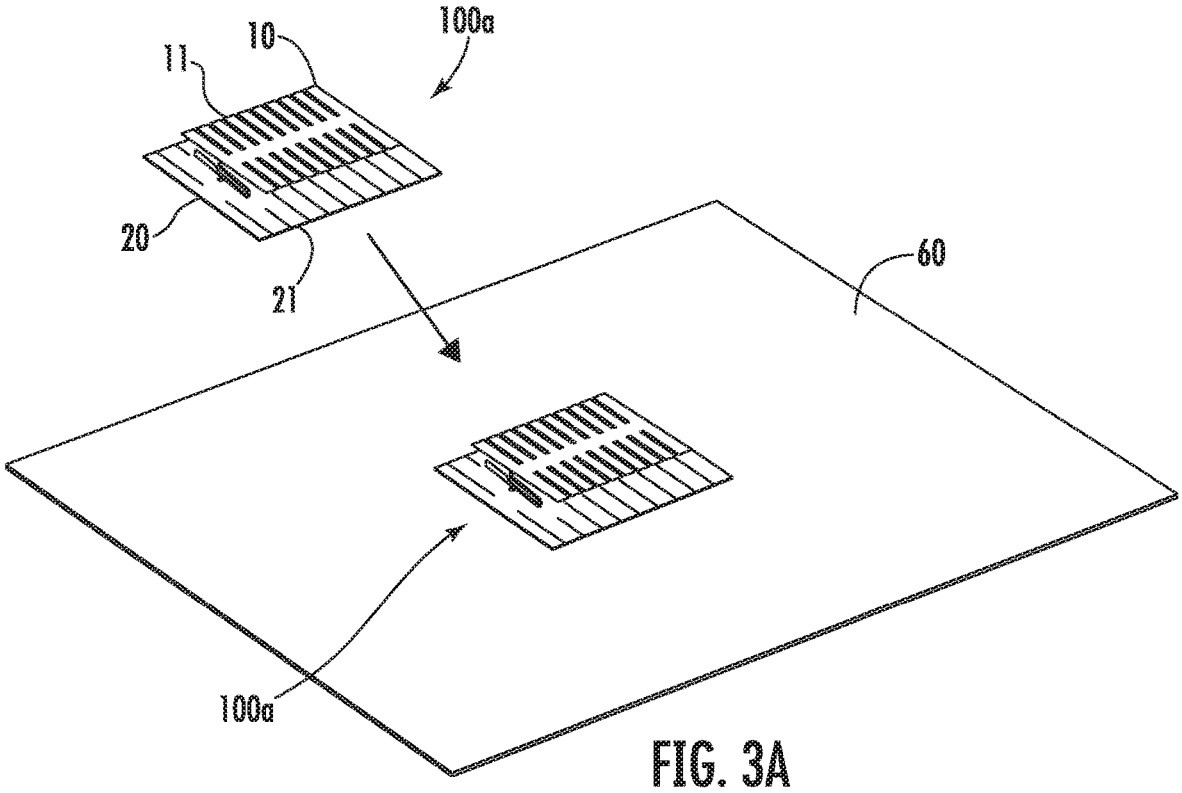
FIG. 3A shows an antenna assembly including an electrically small patch antenna with a modified small ground plane having a plurality of slots therein, the antenna assembly being positioned in free space, and positioned over a large ground plane according to example aspects of the present disclosure.

FIG. 3A shows an antenna assembly 100*a* including an electrically small patch antenna 10 having slots 11 with a modified small ground plane 20 having a plurality of slots 21 therein, the antenna assembly 100*a* being positioned in free space, and positioned over a large ground plane 60.

Figure 3B:
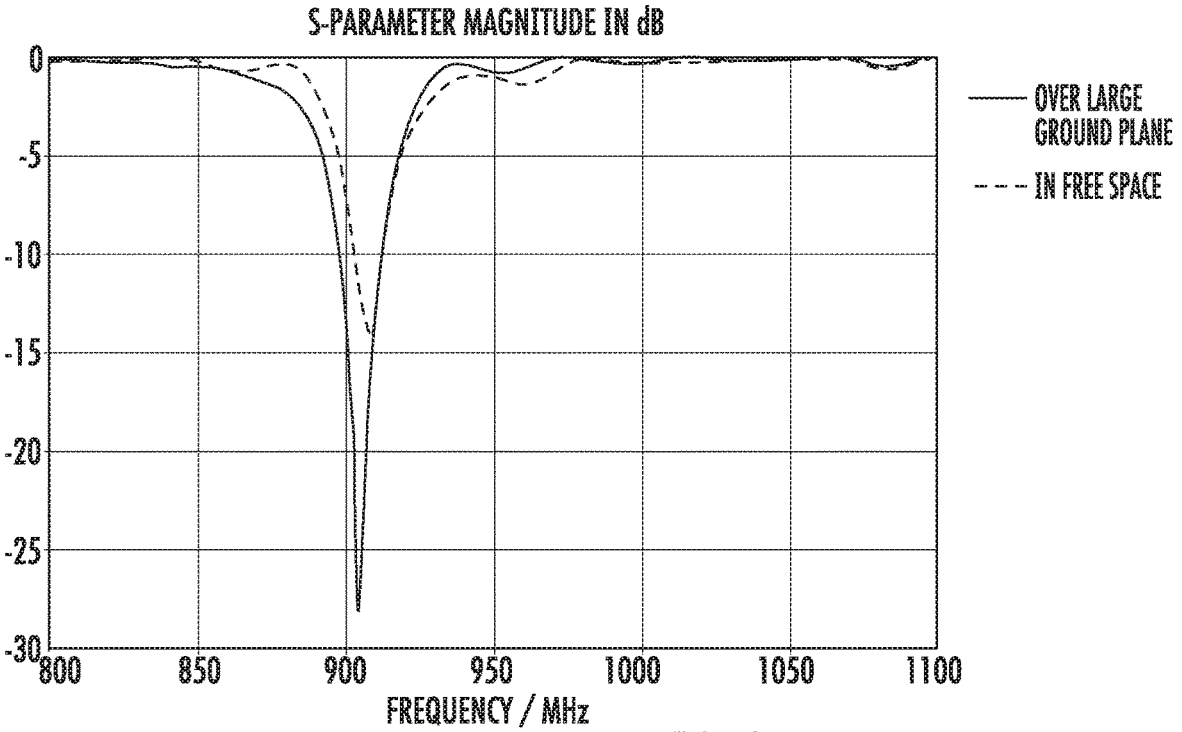
FIG. 3B shows a plot of return loss of the antenna assembly of FIG. 3A being positioned both in free space and also with the antenna assembly positioned over the large ground plane, wherein almost no de-tuning is observed according to example aspects of the present disclosure.

FIG. 3B shows a plot of return loss of the antenna assembly 100*a* of FIG. 3A being positioned both in free space and also with the antenna assembly positioned over the large ground plane 60. Another surprising discovery, the slots in the small ground plane 20 and being positioned above a large ground plane 60 resulted in almost no de-tuning or frequency shift.

Figure 4A:
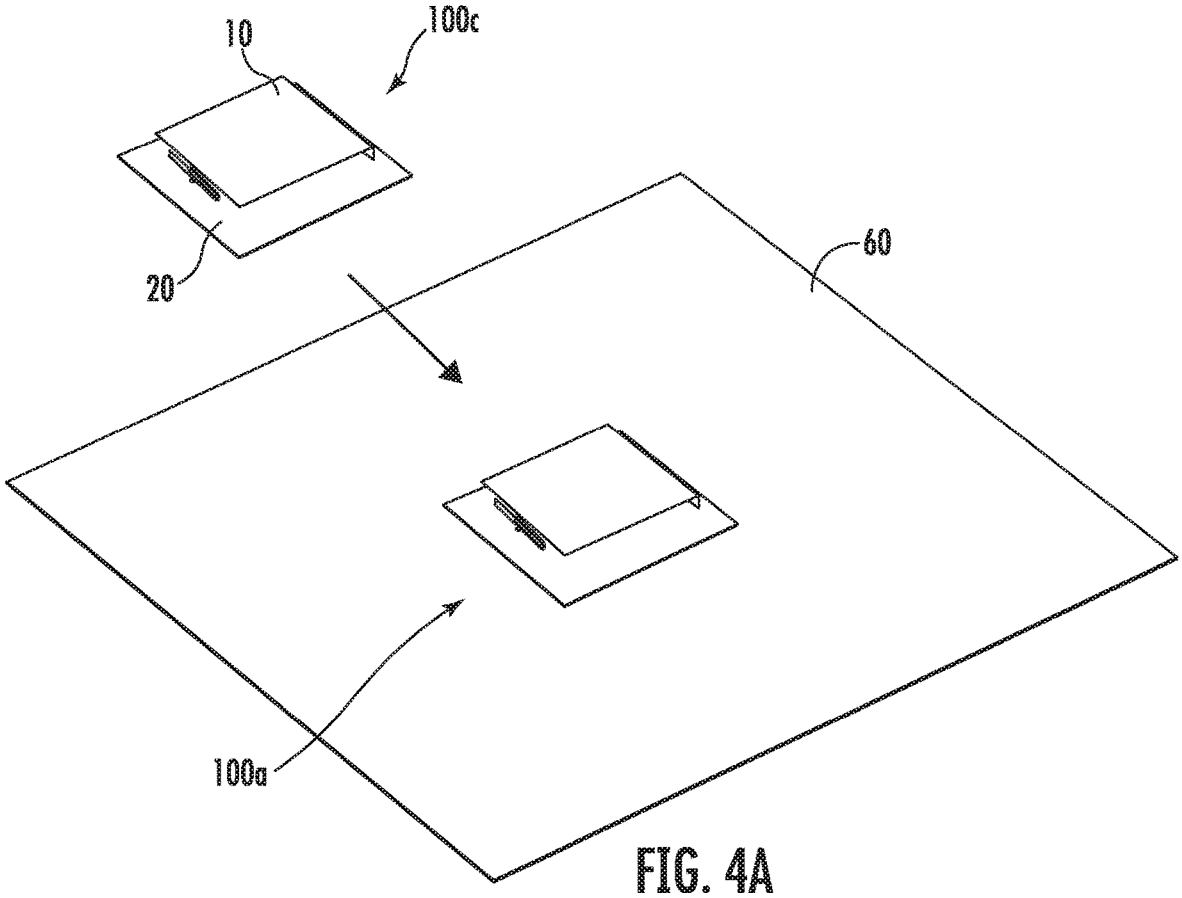
FIG. 4A shows an antenna assembly including a small patch antenna (without slots) with a small ground plane (also without slots), the antenna assembly being positioned in free space, and positioned over a large ground plane according to example aspects of the present disclosure.

FIG. 4A shows an antenna assembly 100*c* including a small patch antenna 10 (without slots) with a small ground plane 20 (also without slots), the antenna assembly 100*c* being positioned in free space, and positioned over a large ground plane 60.

Figure 4B:
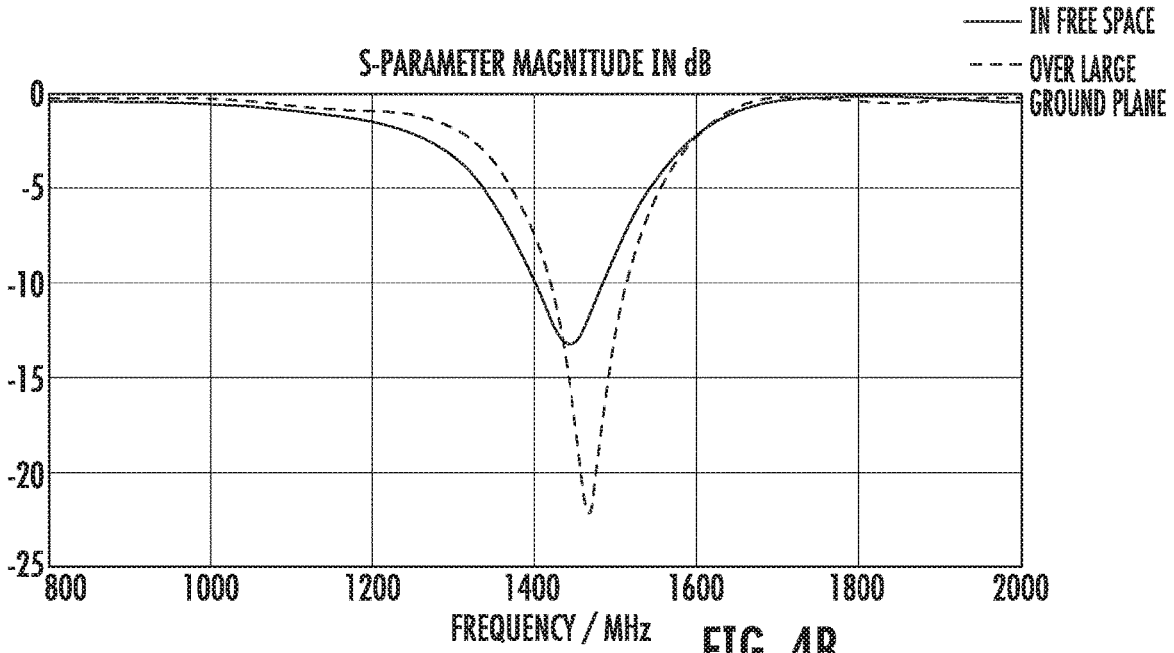
FIG. 4B shows a plot of return loss of the antenna assembly of FIG. 4A being positioned both in free space and also with the antenna assembly positioned over the large ground plane, wherein the resonant frequency of the antenna with no slots (FIG. 4A) is much higher than the antenna assembly of FIG. 2A and that of FIG. 3A, respectively, according to example aspects of the present disclosure.

FIG. 4B shows a plot of return loss of the antenna assembly 100*c* of FIG. 4A being positioned both in free space and also with the antenna assembly positioned over the large ground plane, wherein the resonant frequency of the antenna with no slots (FIG. 4A) is much higher than the antenna assembly of FIG. 2A, and higher than that of FIG. 3A, respectively.

Figure 5A:
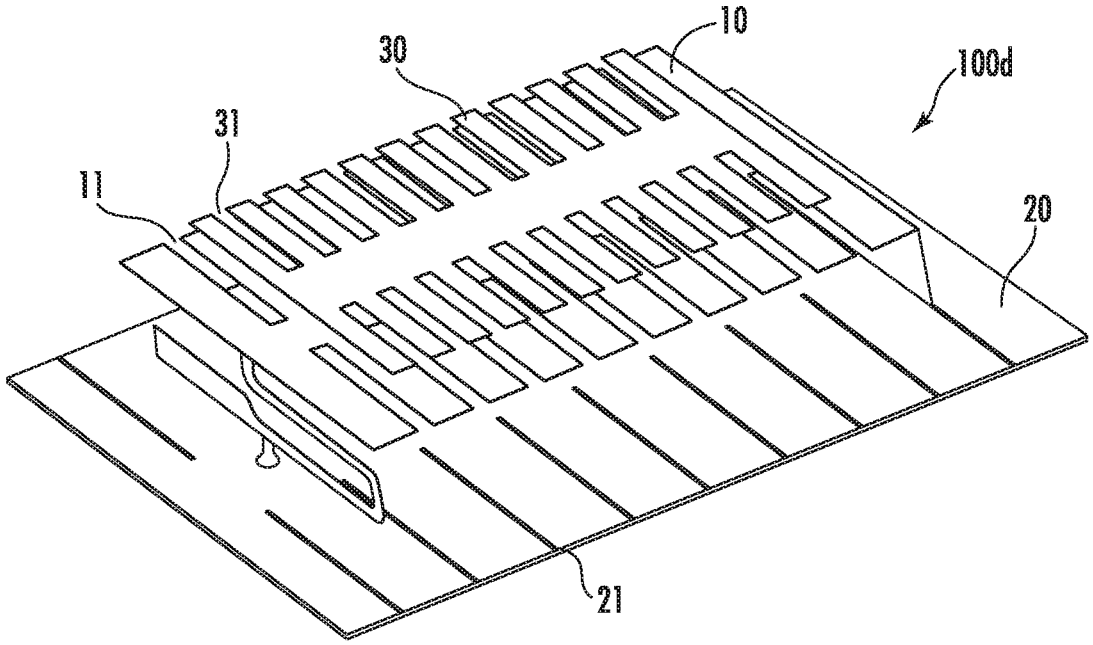
FIG. 5A shows a perspective view of an antenna assembly including an electrically small patch antenna and an electrically small parasitic element positioned parallel to the patch antenna and in proximity therewith, according to example aspects of the present disclosure.

FIG. 5A shows a perspective view of an antenna assembly 100*d* including an electrically small patch 10 having patch slots 11 and an electrically small parasitic conductor element 30 is positioned parallel to the patch and in proximity therewith. The parasitic conductor element 30 further includes parasitic slots 31. The patch 10 is positioned above an electrically small ground plane 20, the small ground plane further comprising ground plane slots 21.

Figure 5B:
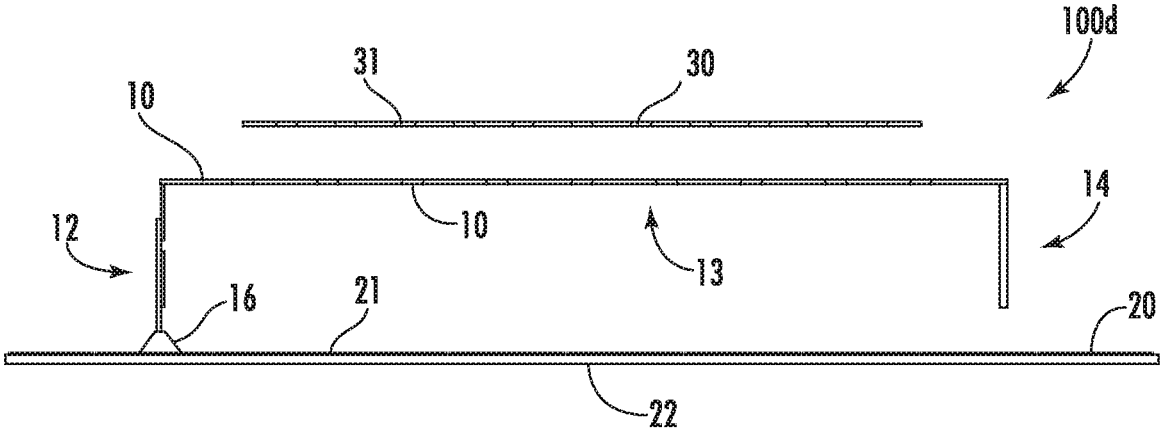
FIG. 5B shows a side view of the antenna assembly of FIG. 5A, according to example aspects of the present disclosure.

FIG. 5B shows a side view of the antenna assembly of FIG. 5A, including the antenna assembly 100*d* and its sub-components, including: substrate 22, electrically small ground plane 21 disposed on the substrate, first vertical portion 12 of the patch conductor 10 soldered to the substrate at solder point 16, horizontal portion 13 of the patch conductor 10 extending horizontally from the first vertical portion to a second vertical portion 14 at a distal end opposite the first vertical portion 12, feed, and solder point, and further including parasitic conductor element 30 having parasitic slots 31. The electrically small parasitic conductor element 30 is positioned in proximity with, and thereby configured to couple with, the electrically small patch 10.

Figure 5C:
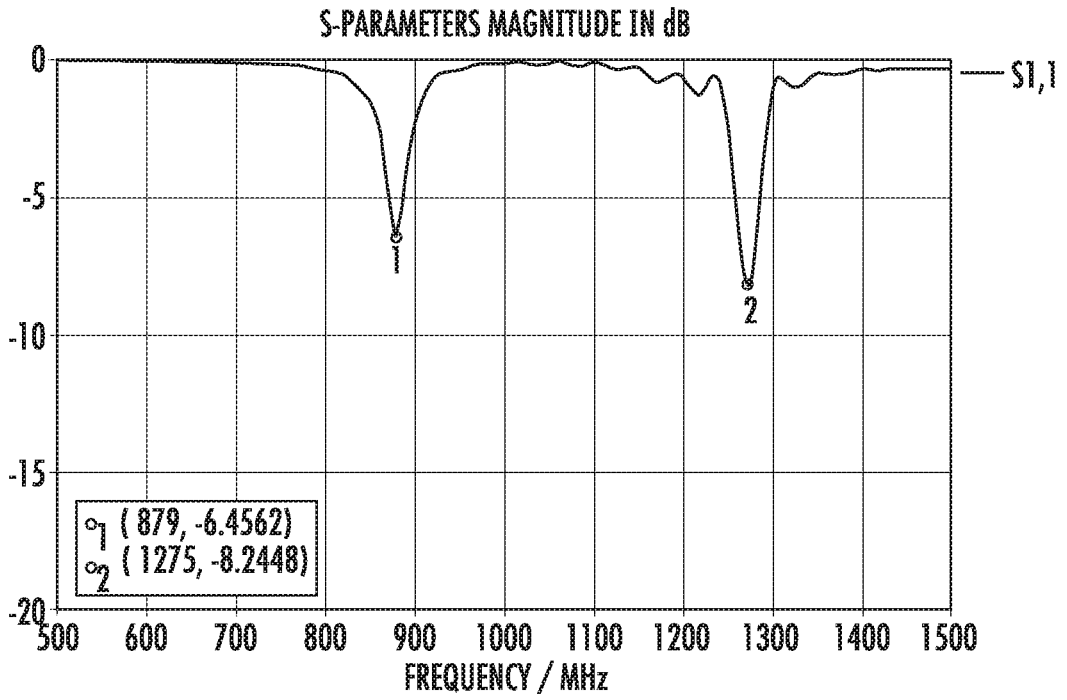
FIG. 5C shows a plot of return loss of the antenna assembly of FIGS. 5A and 5B; a first resonance is attributed to the electrically small patch whereas a second resonance is attributed to the electrically small parasitic conductor element positioned adjacent to the patch antenna according to example aspects of the present disclosure.

FIG. 5C shows a plot of return loss of the antenna assembly 100*d* of FIGS. 5(A-B); a first resonance 1 is attributed to the electrically small patch whereas a second resonance 2 is attributed to the electrically small parasitic conductor element positioned adjacent to the patch. Without the parasitic conductor element, the patch would provide only a single resonance. Thus, by implementing the parasitic conductor element, a second and additional resonance is created.

Figures 5D, 5E:
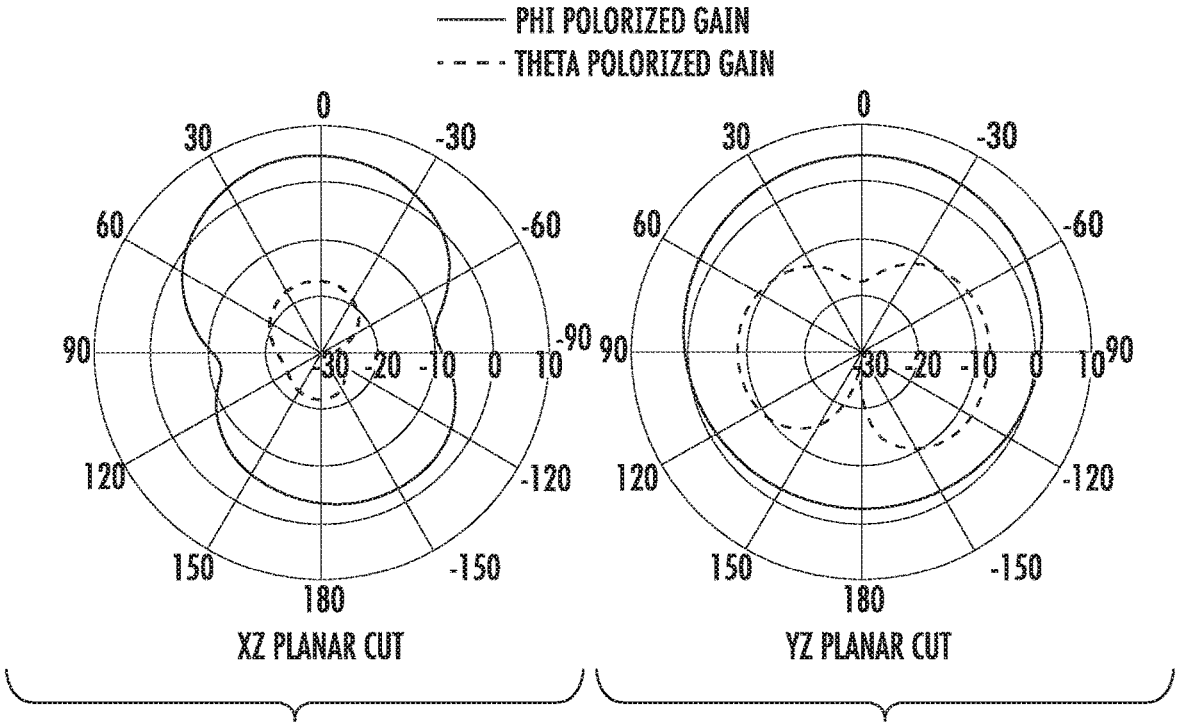
FIG. 5D illustrates the radiation pattern, from an X-Z planar cut, of the antenna assembly of FIG. 5A with respect to the 880 MHz resonance according to example aspects of the present disclosure.
FIG. 5E illustrates the radiation pattern, from a Y-Z planar cut, of the antenna assembly of FIG. 5A with respect to the 880 MHz resonance according to example aspects of the present disclosure.

FIG. 5D illustrates the radiation pattern, from an X-Z planar cut, of the antenna assembly 100*d* of FIG. 5A with respect to the 880 MHz resonance.

FIG. 5E illustrates the radiation pattern, from a Y-Z planar cut, of the antenna assembly 100*d* of FIG. 5A with respect to the 880 MHz resonance.

Figures 5F, 5G:
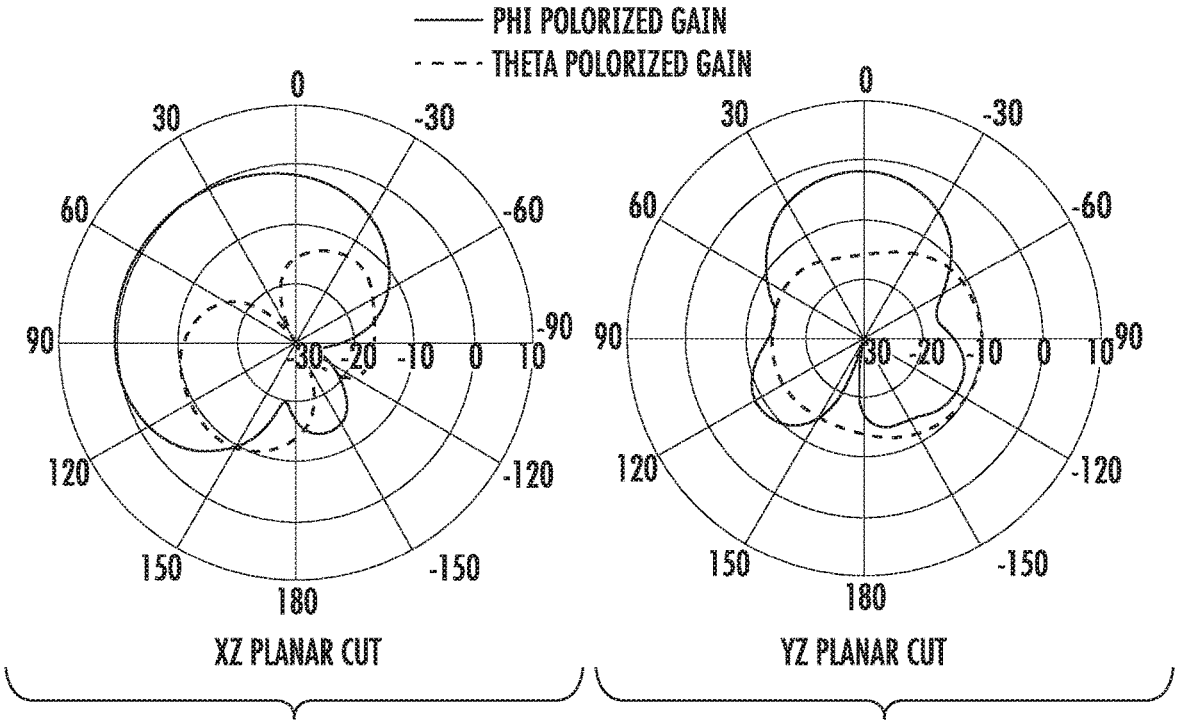
FIG. 5F illustrates the radiation pattern, from an X-Z planar cut, of the antenna assembly of FIG. 5A with respect to the 2175 MHz resonance according to example aspects of the present disclosure.
FIG. 5G illustrates the radiation pattern, from a Y-Z planar cut, of the antenna assembly of FIG. 5A with respect to the 2175 MHz resonance according to example aspects of the present disclosure.

FIG. 5F illustrates the radiation pattern, from an X-Z planar cut, of the antenna assembly 100*d* of FIG. 5A with respect to the 2175 MHz resonance.

FIG. 5G illustrates the radiation pattern, from a Y-Z planar cut, of the antenna assembly 100*d* of FIG. 5A with respect to the 2175 MHz resonance.

Figure 6A:
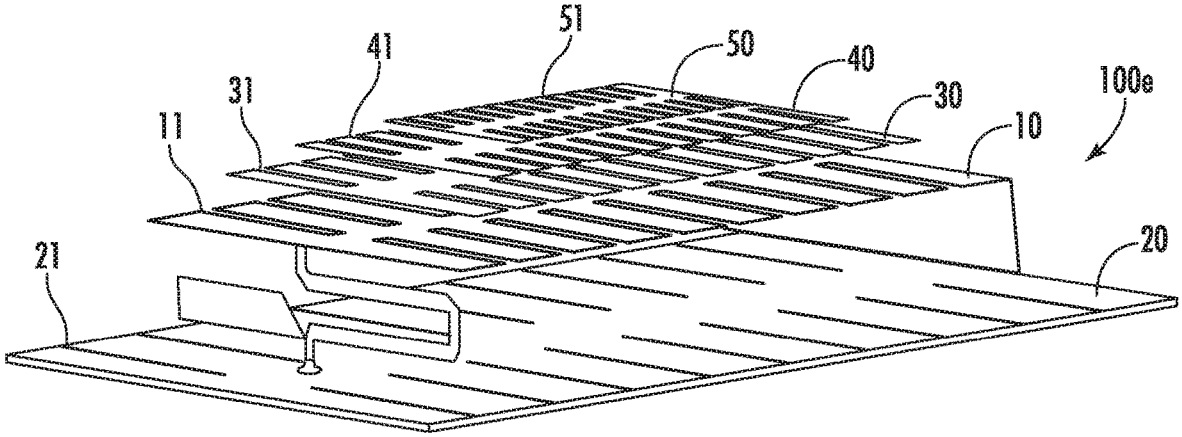
FIG. 6A shows a perspective view of an antenna assembly including an electrically small patch and multiple electrically small parasitic conductor elements positioned adjacent to the patch according to example aspects of the present disclosure.

FIG. 6A shows a perspective view of an antenna assembly 100*e* including an electrically small patch 10 and multiple electrically small parasitic conductor elements 30; 40; 50, respectively, each positioned adjacent to the patch 10. The patch and parasitic conductor elements may be each positioned above ground plane 20.

The ground plane 20 comprises ground plane slots 21; the patch 10 comprises patch slots 11; the first parasitic conductor element 30 disposed above the patch comprises first parasitic slots 31; and the second parasitic conductor element 40 positioned above the patch comprises second parasitic slots 41; and the third parasitic conductor element 50 comprises third parasitic slots 51.

Figure 6B:
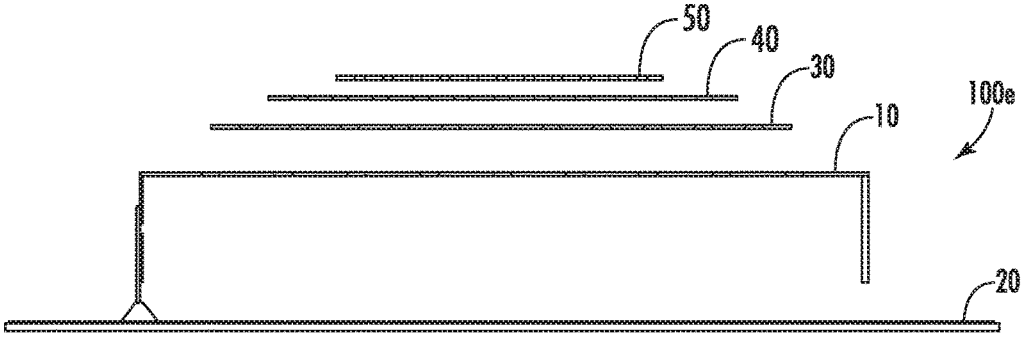
FIG. 6B shows a side view of the antenna assembly of FIG. 6A according to example aspects of the present disclosure.

FIG. 6B shows a side view of the antenna assembly 100*e* of FIG. 6A. Each of the small ground plane 20, patch 10, first parasitic conductor element 30, second parasitic conductor element 40, and third parasitic conductor element 50 are shown.

Figure 6C:
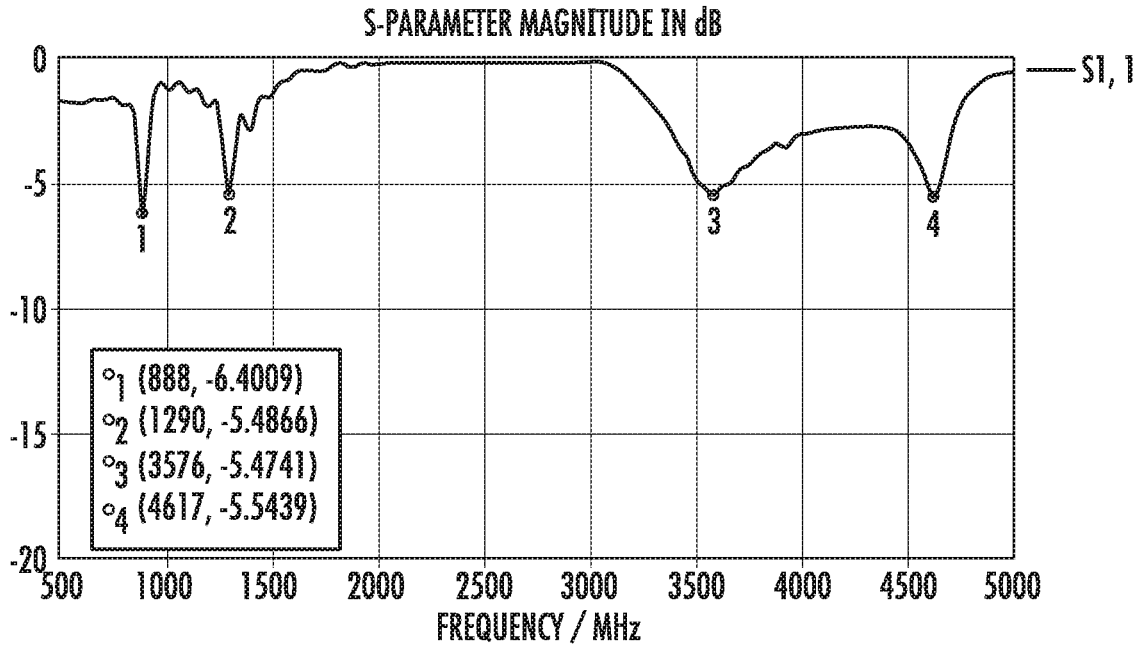
FIG. 6C shows a plot of return loss of the antenna assembly of FIGS. 6A and 6B; a first resonance is attributed to the electrically small patch whereas second thru fourth resonances are each attributed to one of the electrically small parasitic conductor elements positioned adjacent to the patch according to example aspects of the present disclosure.

FIG. 6C shows a plot of return loss of the antenna assembly 100*e* of FIGS. 6(A-B); a first resonance 1 is attributed to the electrically small patch whereas second thru fourth resonances (2; 3; 4) are each attributed to one of the electrically small parasitic conductor elements positioned adjacent to the patch 10.

Figure 6D:
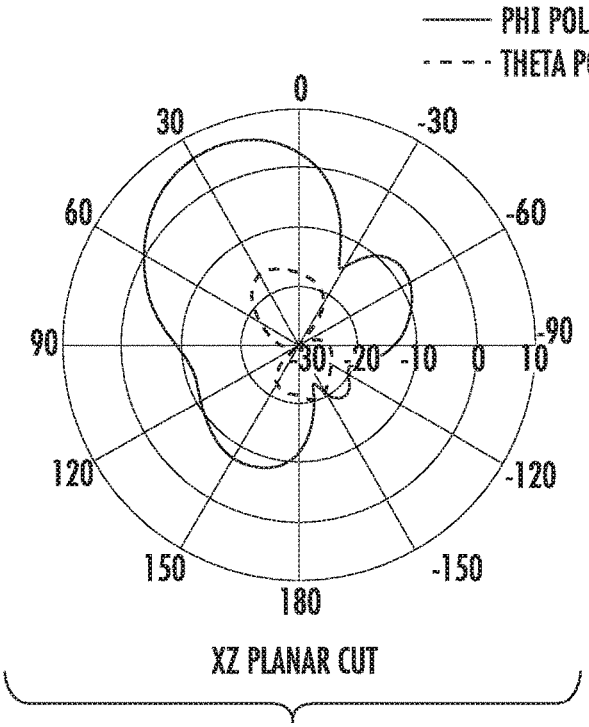
FIG. 6D illustrates the radiation pattern, from an X-Z planar cut, of the antenna assembly of FIG. 6A with respect to the 3575 MHz resonance according to example aspects of the present disclosure.

FIG. 6D illustrates the radiation pattern, from an X-Z planar cut, of the antenna assembly 100*e* of FIG. 6A with respect to the 3575 MHz resonance.

Figure 6E:
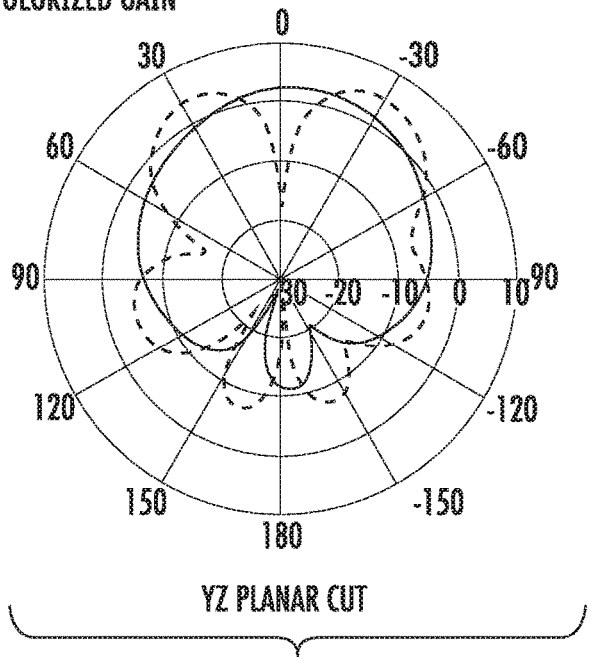
FIG. 6E illustrates the radiation pattern, from a Y-Z planar cut, of the antenna assembly of FIG. 6A with respect to the 3575 MHz resonance according to example aspects of the present disclosure.

FIG. 6E illustrates the radiation pattern, from a Y-Z planar cut, of the antenna assembly 100*e* of FIG. 6A with respect to the 3575 MHz resonance.

Figure 6F:
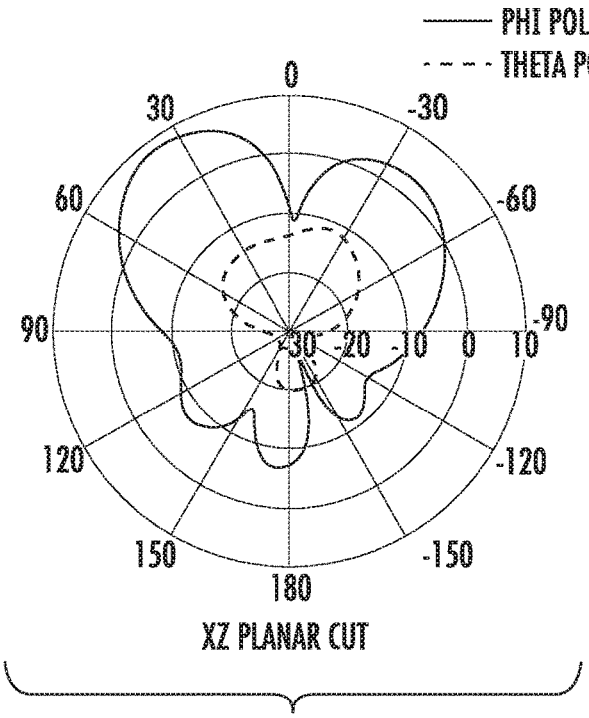
FIG. 6F illustrates the radiation pattern, from an X-Z planar cut, of the antenna assembly of FIG. 6A with respect to the 4615 MHz resonance according to example aspects of the present disclosure.

FIG. 6F illustrates the radiation pattern, from an X-Z planar cut, of the antenna assembly 100*e* of FIG. 6A with respect to the 4615 MHz resonance.

Figure 6G:
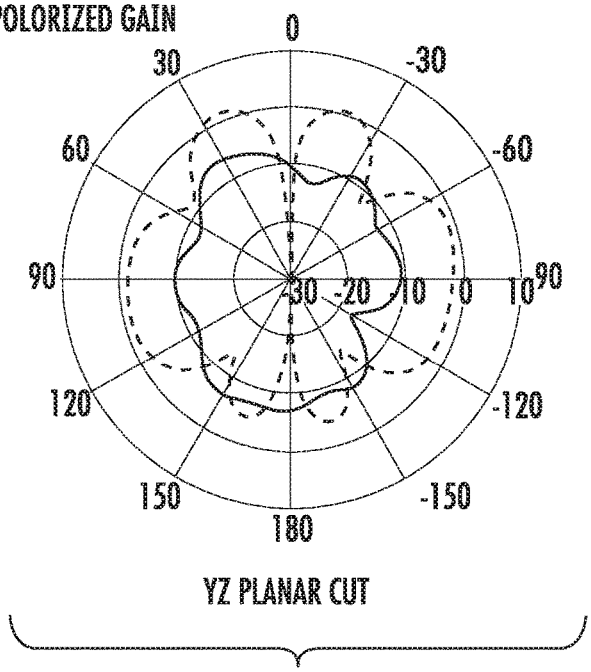
FIG. 6G illustrates the radiation pattern, from a Y-Z planar cut, of the antenna assembly of FIG. 6A with respect to the 4615 MHz resonance according to example aspects of the present disclosure.

FIG. 6G illustrates the radiation pattern, from a Y-Z planar cut, of the antenna assembly 100*e* of FIG. 6A with respect to the 4615 MHz resonance.

Now, certain design variations

Figure 7A:
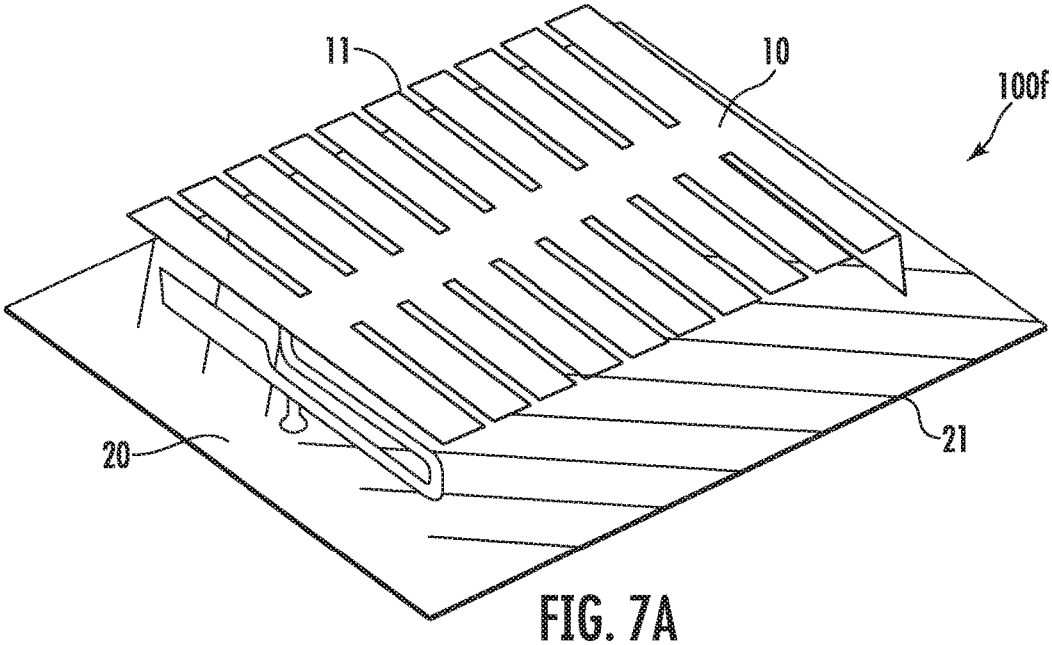
FIG. 7A shows a perspective view of an antenna assembly including an electrically small patch positioned above an electrically small ground plane having angled slots embedded therein according to example aspects of the present disclosure.

FIG. 7A shows a perspective view of an antenna assembly 100*f* including an electrically small patch 10 with straight slots 11 being positioned above an electrically small ground plane 20 having angled slots 21*b* embedded therein.

Figures 7B, 7C:
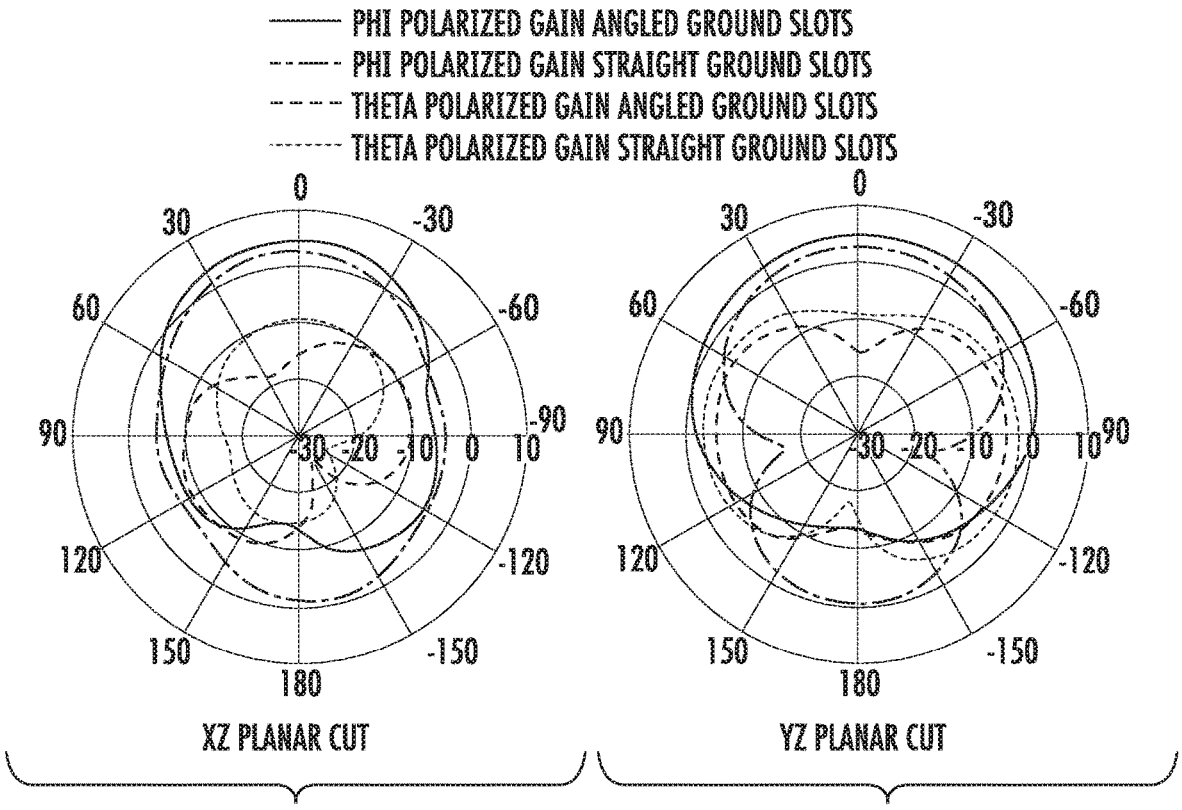
FIG. 7B illustrates a plot of the radiation pattern of the antenna assembly of FIG. 7A with respect to the X-Z planar cut, in which a peak gain and a front-to-back ratio are increased with respect to the embodiment of the antenna depicted in FIG. 1A.
FIG. 7C illustrates a plot of the radiation pattern of the antenna assembly of FIG. 7A with respect to the Y-Z planar cut, in which a peak gain and a front-to-back ratio are increased with respect to the embodiment of the antenna depicted in FIG. 1A.

FIG. 7B illustrates a plot of the radiation pattern of the antenna assembly 100*f* of FIG. 7A with respect to the X-Z planar cut; peak gain and front-to-back ratio increased for the antenna assembly 100*f* with angled slots when compared to the antenna assembly 100*a* with straight slots (FIG. 1A).

FIG. 7C illustrates a plot of the radiation pattern of the antenna assembly 100*f* of FIG. 7A with respect to the Y-Z planar cut; peak gain and front-to-back ratio increased for the antenna assembly 100*f* with angled slots when compared to the antenna assembly 100*a* with straight slots (FIG. 1A).

With respect to FIGS. 7B and 7C, the ground plane with straight slots in the XZ planar cut, phi polarization, achieves peak gain: 2.9 dBi, phi polarization 3 dB beam width: 74°, phi polarization front-to-back ratio: 3.7 dB. The ground plane with straight slots in the YZ planar cut, phi polarization, achieves peak gain: 2.9 dBi, phi polarization 3 dB beam width: 75°, phi polarization front-to-back ratio: 3.7 dB. The ground plane with angled slots in the XZ planar cut, phi polarization, achieves peak gain: 4.9 dBi, phi polarization 3 dB beam width: 76°, phi polarization front-to-back ratio: 18.1 dB. The ground plane with angled slots in the YZ planar cut, phi polarization, achieves peak gain: 4.9 dBi, phi polarization 3 dB beam width: 123°, phi polarization front-to-back ratio: 18.1 dB.

Figure 8A:
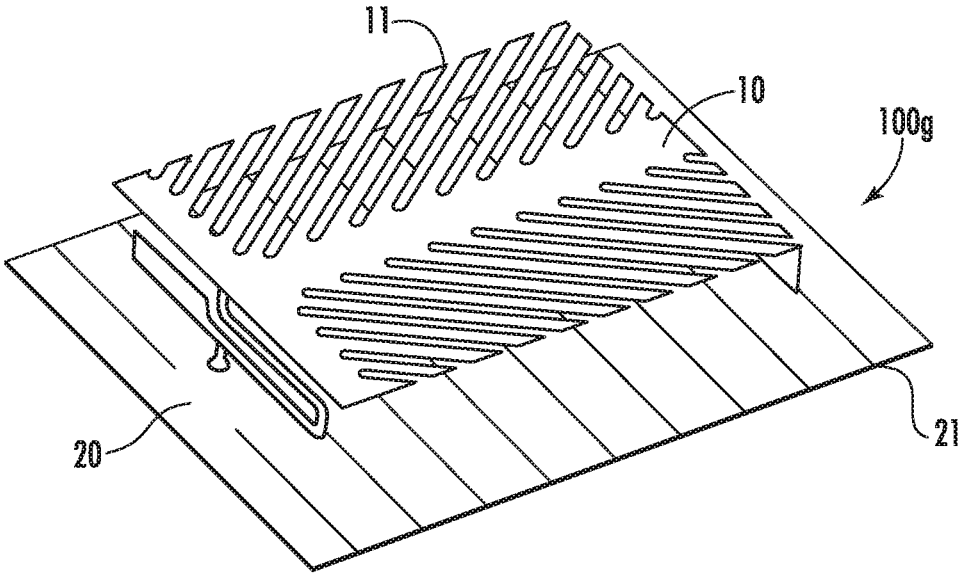
FIG. 8A shows an antenna assembly including an electrically small patch antenna with angled slots being positioned above an electrically small ground plane, the ground plane having straight slots, according to example aspects of the present disclosure.

FIG. 8A shows an antenna assembly 100*g* including an electrically small patch antenna 10 with angled slots 11*b* being positioned above an electrically small ground plane 20 with straight slots 21.

Figure 8B:
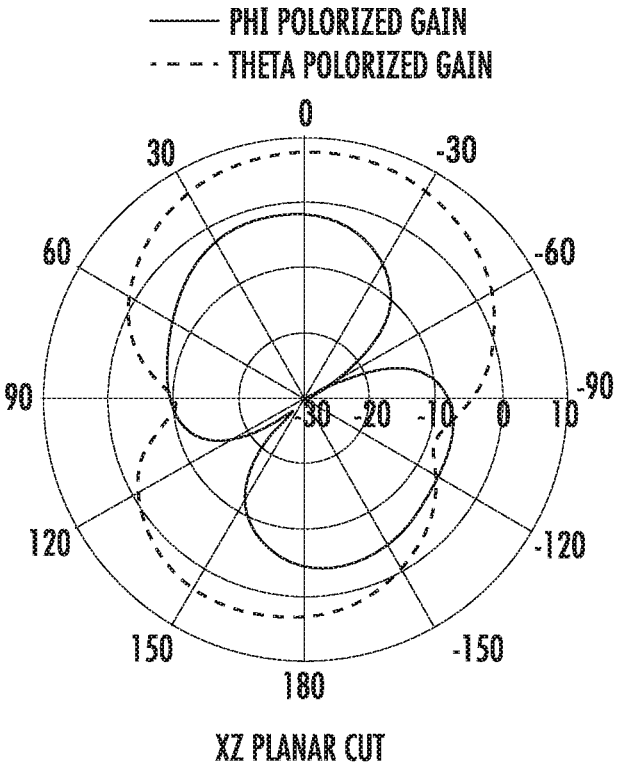
FIG. 8B illustrates the radiation pattern of the antenna of FIG. 8A taken from the X-Z planar cut, in which the angled slots are observed to swap the dominate polarization of the antenna with comparison to the plot of FIG. 1B, according to example aspects of the present disclosure.

FIG. 8B illustrates the radiation pattern of the antenna assembly 100*g* of FIG. 8A taken from the X-Z planar cut; the angled slots 11*b* are observed to swap the dominate polarization of the antenna assembly 100*g* with comparison to the plot of FIG. 1B and antenna assembly 100*a*.

Figure 9A:
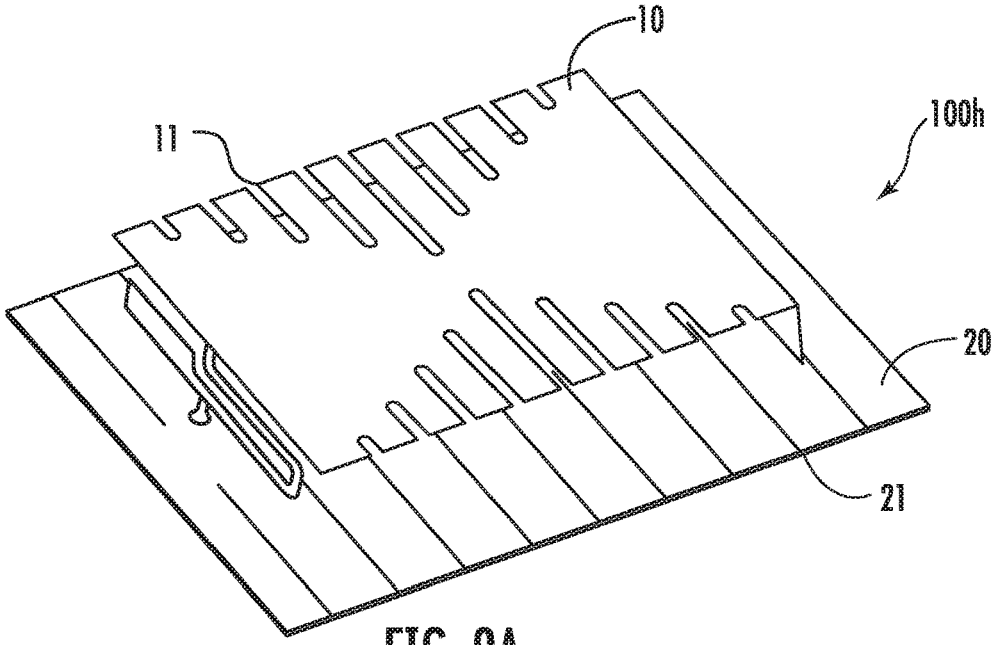
FIG. 9A shows a perspective view of an antenna assembly including an electrically small patch with concave slots embedded therein being positioned above an electrically small ground plane having straight slots according to example aspects of the present disclosure.

FIG. 9A shows a perspective view of an antenna assembly 100*h* including an electrically small patch 10 with concave slots 11*c* embedded therein, the patch 10 being positioned above an electrically small ground plane 20 having straight slots 21.

Figures 9B, 9C:
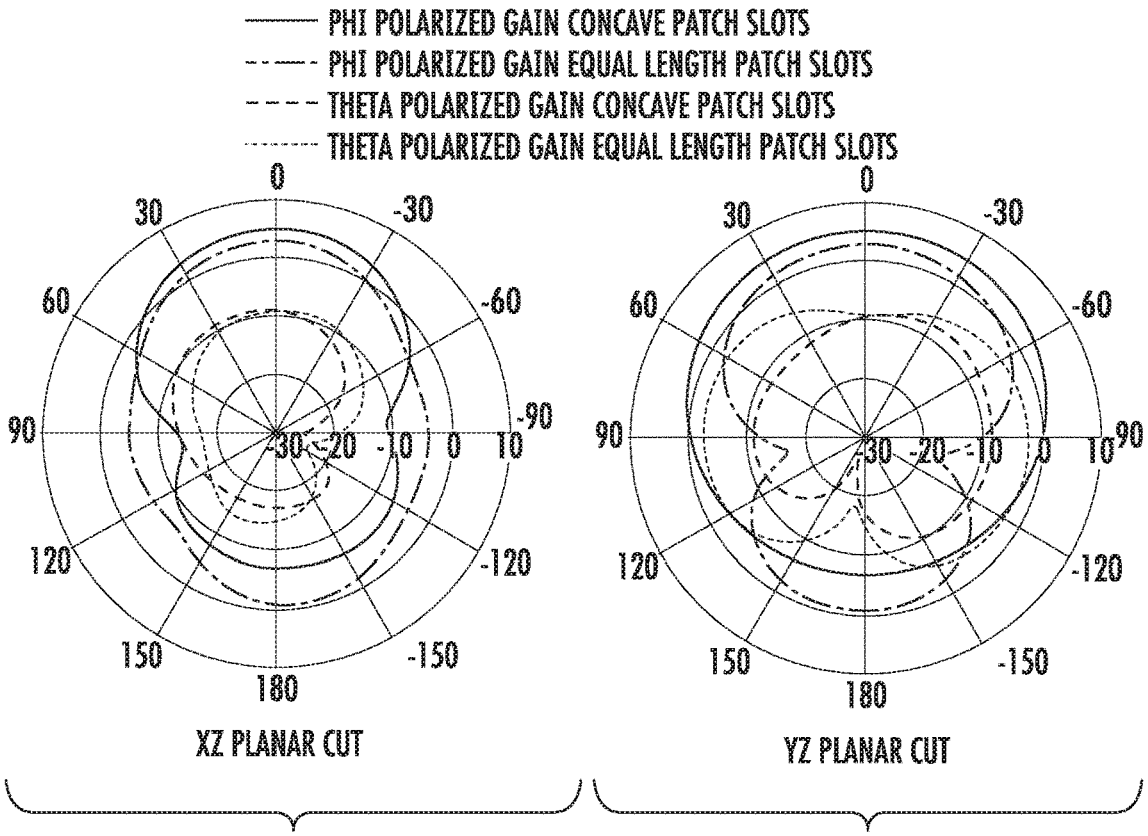
FIG. 9B illustrates a plot of the radiation pattern of the antenna assembly of FIG. 9A with respect to the X-Z planar cut, in which a peak gain and front-to-back ratio is increased for the antenna with angled slots when compared to the antenna of FIG. 1A with straight slots.
FIG. 9C illustrates a plot of the radiation pattern of the antenna assembly of FIG. 9A with respect to the Y-Z planar cut, in which a peak gain and a front-to-back ratio are increased with respect to the embodiment of the antenna depicted in FIG. 1A.

FIG. 9B illustrates a plot of the radiation pattern of the antenna assembly 100*h* of FIG. 9A with respect to the X-Z planar cut; peak gain and front-to-back ratio increased for the antenna assembly 100*h* with concave slots 11*c* when compared to the antenna assembly 100*a* with straight slots (FIG. 1A).

FIG. 9C illustrates a plot of the radiation pattern of the antenna assembly 100*h* of FIG. 9A with respect to the Y-Z planar cut; peak gain and front-to-back ratio increased for the antenna assembly 100*h* with concave slots 11*c* when compared to the antenna assembly 100*a* with straight slots (FIG. 1A).

With respect to FIGS. 9B and 9C, the ground plane with equal length slots in the XZ planar cut, phi polarization, achieves peak gain: 2.9 dBi, phi polarization 3 dB beam width: 74°, phi polarization front-to-back ratio: 3.7 dB. The ground plane with equal length slots in the YZ planar cut phi polarization achieves peak gain: 2.9 dBi, phi polarization 3 dB beam width: 75°, phi polarization front-to-back ratio: 3.7 dB. The ground plane with concave slots in the XZ planar cut, phi polarization, achieves peak gain: 4.9 dBi, phi polarization 3 dB beam width: 75°, phi polarization front-to-back ratio: 11.8 dB. The ground plane with concave slots in the YZ planar cut phi polarization achieves peak gain: 4.9 dBi, phi polarization 3 dB beam width: 127°, phi polarization front-to-back ratio: 11.8 dB.

Figure 10A:
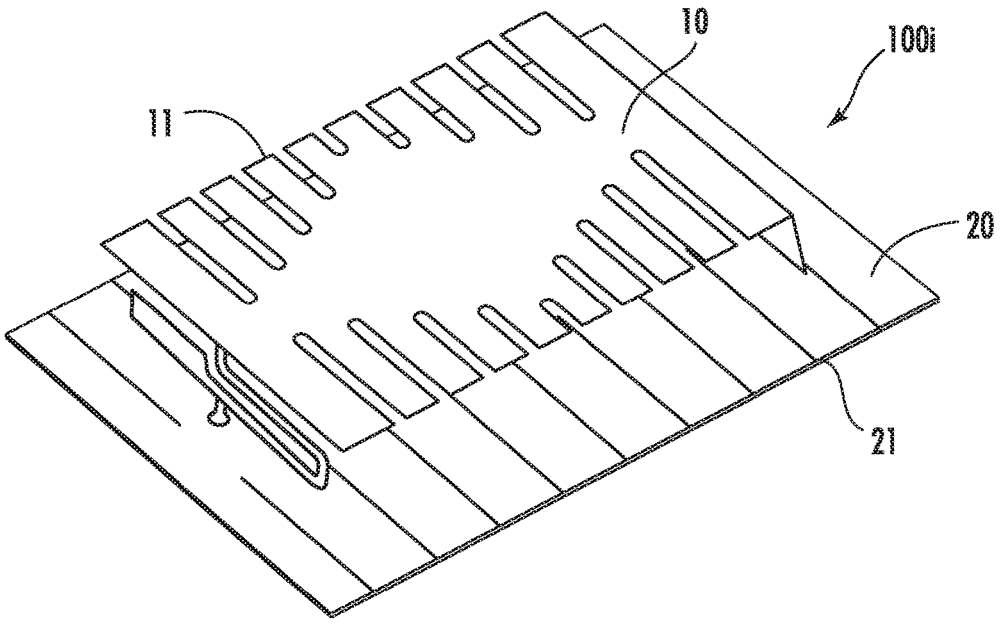
FIG. 10A shows a perspective view of an antenna assembly including an electrically small patch with convex slots embedded therein being positioned above an electrically small ground plane having straight slots, according to example aspects of the present disclosure.

FIG. 10A shows a perspective view of an antenna assembly 100*i* including an electrically small patch 10 with convex slots 11*d* embedded therein, the patch being positioned above an electrically small ground plane 20 having straight slots 21.

Figures 10B, 10C:
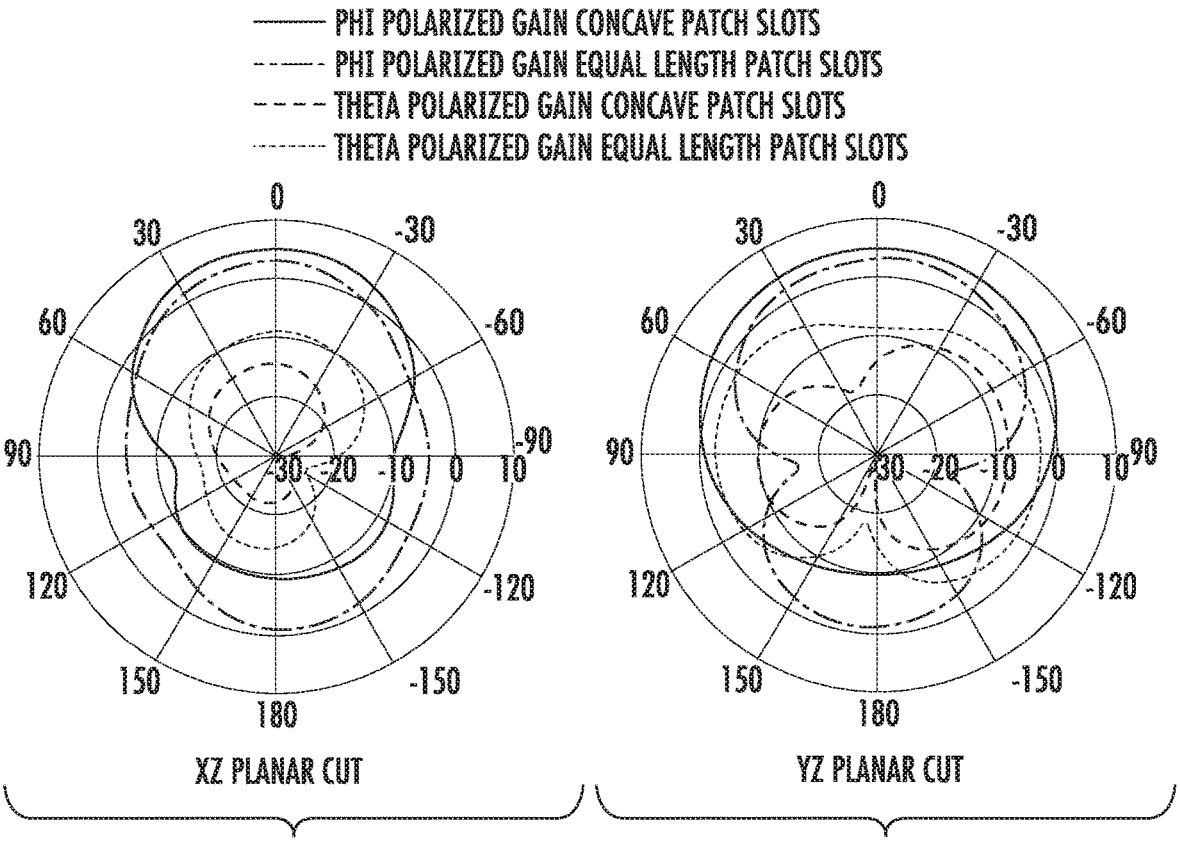
FIG. 10B illustrates a plot of the radiation pattern of the antenna assembly of FIG. 10A with respect to the X-Z planar cut, in which a peak gain and a front-to-back ratio are increased with respect to the embodiment of the antenna depicted in FIG. 1A.
FIG. 10C illustrates a plot of the radiation pattern of the antenna assembly of FIG. 10A with respect to the Y-Z planar cut, in which a peak gain and a front-to-back ratio are increased with respect to the embodiment of the antenna depicted in FIG. 1A.

FIG. 10B illustrates a plot of the radiation pattern of the antenna assembly 100*i* of FIG. 10A with respect to the X-Z planar cut; peak gain and front-to-back ratio increased for the antenna assembly 100*i* with convex slots 11*c* when compared to the antenna assembly 100*a* with straight slots (FIG. 1A).

FIG. 10C illustrates a plot of the radiation pattern of the antenna assembly 100*i* of FIG. 10A with respect to the Y-Z planar cut; peak gain and front-to-back ratio increased for the antenna assembly 100*i* with convex slots 11*c* when compared to the antenna assembly 100*a* with straight slots (FIG. 1A).

With respect to FIGS. 10B and 10C, the ground plane with equal length slots in the XZ planar cut, phi polarization, achieves peak gain: 2.9 dBi, phi polarization 3 dB beam width: 74°, phi polarization front-to-back ratio: 3.7 dB. The ground plane with equal length slots in the YZ planar cut, phi polarization, achieves peak gain: 2.9 dBi, phi polarization 3 dB beam width: 75°, phi polarization front-to-back ratio: 3.7 dB. The ground plane with convex slots in the XZ planar cut phi polarization achieves peak gain: 4.9 dBi, phi polarization 3 dB beam width: 77°, phi polarization front-to-back ratio: 14.6 dB. The ground plane with convex slots in the YZ planar cut phi polarization achieves peak gain: 4.9 dBi, phi polarization 3 dB beam width: 125°, phi polarization front-to-back ratio: 14.6 dB.

Figure 11A:
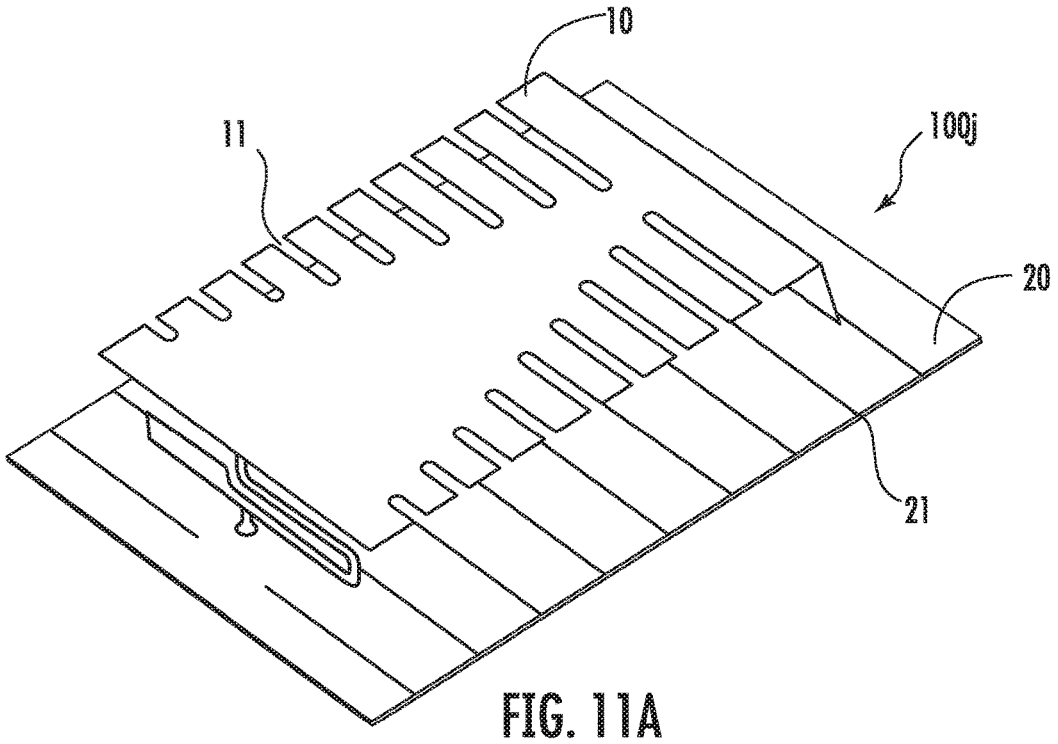
FIG. 11A shows a perspective view of an antenna assembly including an electrically small patch with slots tapered from a feed edge to a non-feed edge, the patch being positioned above an electrically small ground plane having straight slots, according to example aspects of the present disclosure.

FIG. 11A shows a perspective view of an antenna assembly 100*j* including an electrically small patch 10 with first tapered slots 11*e* being tapered from a feed edge (FE) to a non-feed edge (NFE), the patch 10 being positioned above an electrically small ground plane 20 having straight slots 21.

Figures 11B, 11C:
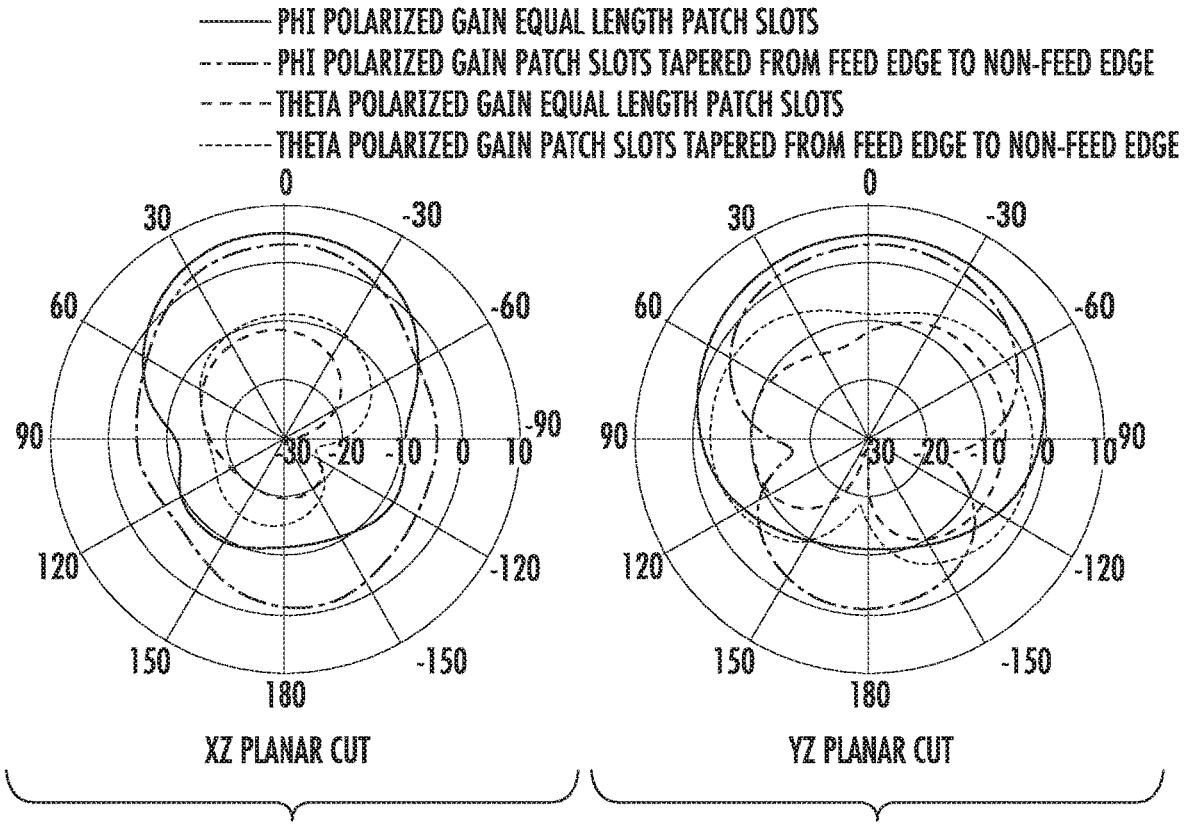
FIG. 11B illustrates a plot of the radiation pattern of the antenna assembly of FIG. 11A with respect to the X-Z planar cut, in which a peak gain and a front-to-back ratio are increased with respect to the embodiment of the antenna depicted in FIG. 1A.
FIG. 11C illustrates a plot of the radiation pattern of the antenna assembly of FIG. 11A with respect to the Y-Z planar cut, in which a peak gain and a front-to-back ratio are increased with respect to the embodiment of the antenna depicted in FIG. 1A.

FIG. 11B illustrates a plot of the radiation pattern of the antenna assembly 100*j* of FIG. 11A with respect to the X-Z planar cut; peak gain and front-to-back ratio increased for the antenna assembly 100*j* with first tapered slots 11*e* when compared to the antenna assembly 100*a* with straight slots (FIG. 1A).

FIG. 11C illustrates a plot of the radiation pattern of the antenna assembly 100*j* of FIG. 11A with respect to the Y-Z planar cut; peak gain and front-to-back ratio increased for the antenna assembly 100*j* with first tapered slots 11*e* when compared to the antenna assembly 100*a* with straight slots (FIG. 1A).

With respect to FIGS. 11B and 11C, the ground plane with equal length slots in the XZ planar cut phi polarization achieves peak gain: 2.9 dBi, phi polarization 3 dB beam width: 74°, phi polarization front-to-back ratio: 3.7 dB. The ground plane with equal length slots in the YZ planar cut phi polarization achieves peak gain: 2.9 dBi, phi polarization 3 dB beam width: 75°, phi polarization front-to-back ratio: 3.7 dB. The ground plane with slots tapered from feed edge to non-feed edge (first tapered slots) in the XZ planar cut phi polarization achieves peak gain: 4.7 dBi, phi polarization 3 dB beam width: 76°, phi polarization front-to-back ratio: 15.8 dB. The ground plane with slots tapered from feed edge to non-feed edge (first tapered slots) in the YZ planar cut phi polarization achieves peak gain: 4.7 dBi, phi polarization 3 dB beam width: 124°, phi polarization front-to-back ratio: 15.8 dB.

Figure 12A:
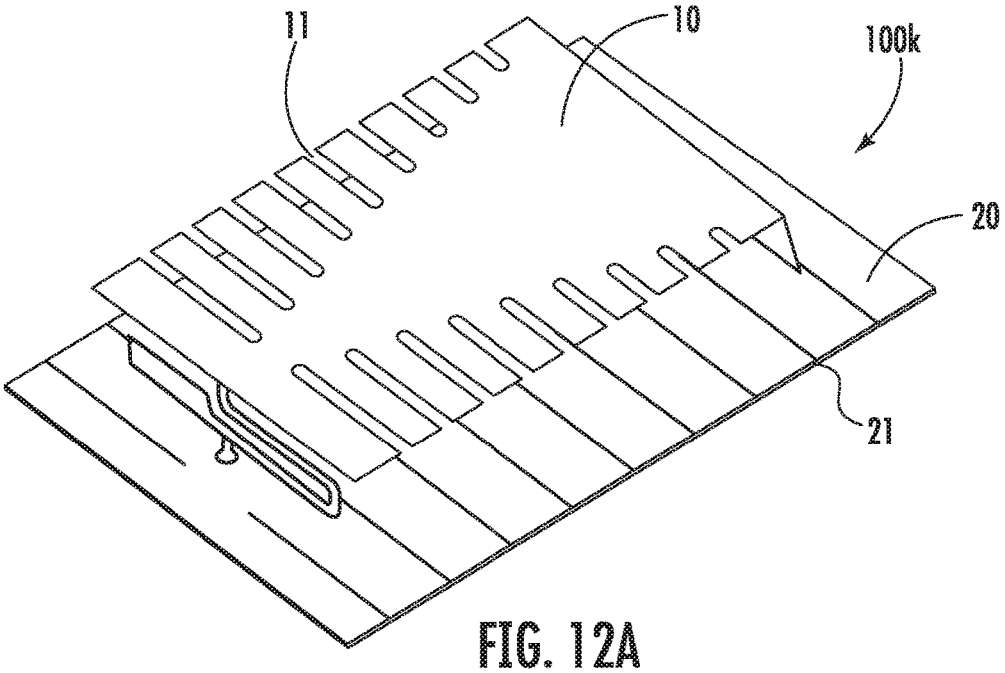
FIG. 12A shows a perspective view of an antenna assembly including an electrically small patch with slots tapered from a non-feed edge to a feed edge, the patch being positioned above an electrically small ground plane having straight slots, according to example aspects of the present disclosure.

FIG. 12A shows a perspective view of an antenna assembly 100*k* including an electrically small patch 10 with second tapered slots 11*f* extending from a non-feed edge (NFE) to a feed edge (FE), which the opposite orientation of the design shown in FIG. 11A, the patch 10 being positioned above an electrically small ground plane 20 having straight ground plane slots 21.

Figures 12B, 12C:
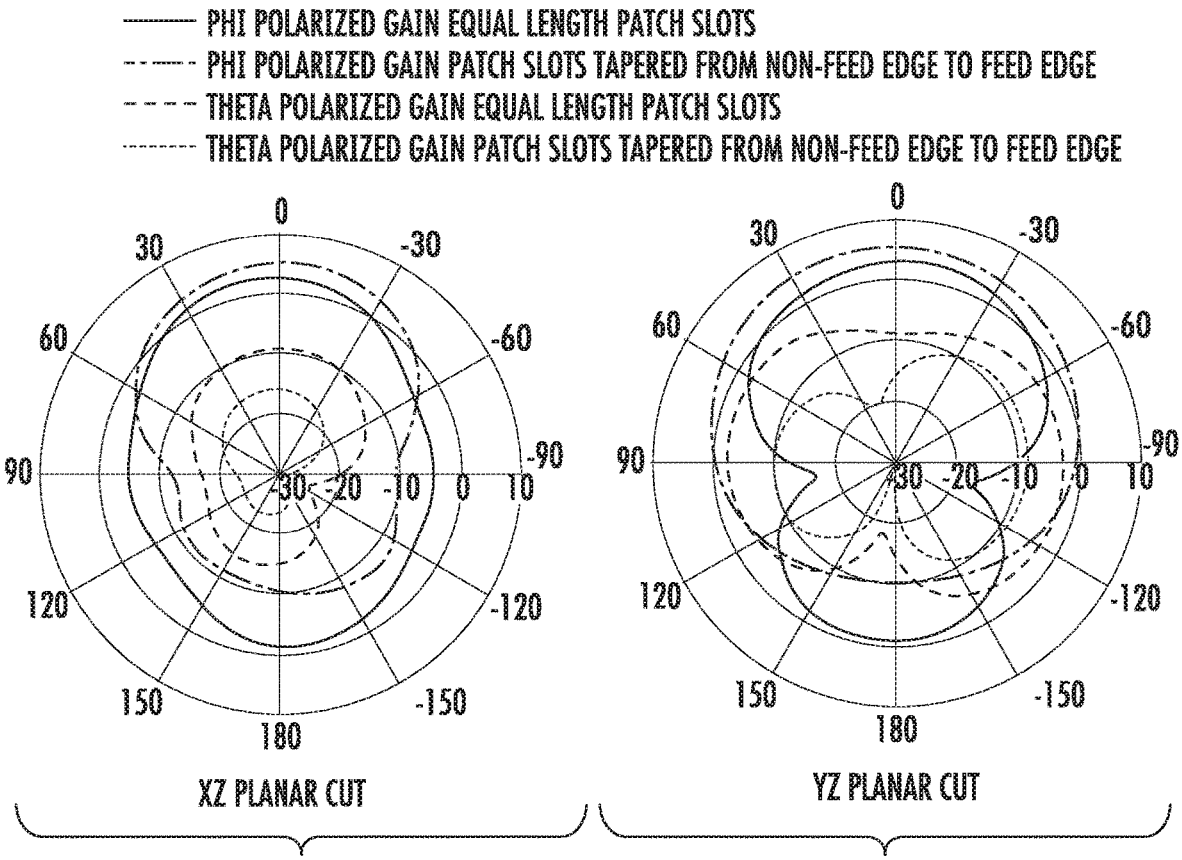
FIG. 12B illustrates a plot of the radiation pattern of the antenna assembly of FIG. 12A with respect to the X-Z planar cut, in which a peak gain and a front-to-back ratio are increased with respect to the embodiment of the antenna depicted in FIG. 1A.
FIG. 12C illustrates a plot of the radiation pattern of the antenna assembly of FIG. 12A with respect to the Y-Z planar cut, in which a peak gain and a front-to-back ratio are increased with respect to the embodiment of the antenna depicted in FIG. 1A.

FIG. 12B illustrates a plot of the radiation pattern of the antenna assembly 100*k* of FIG. 12A with respect to the X-Z planar cut; peak gain and front-to-back ratio increased for the antenna assembly 100*k* with second tapered slots when compared to the antenna assembly 100*a* with straight slots (FIG. 1A).

FIG. 12C illustrates a plot of the radiation pattern of the antenna assembly 100*k* of FIG. 12A with respect to the Y-Z planar cut; peak gain and front-to-back ratio increased for the antenna assembly 100*k* with second tapered slots when compared to the antenna assembly 100*a* with straight slots (FIG. 1A).

Finally, with respect to FIGS. 12B and 12C, the ground plane with equal length slots in the XZ planar cut phi polarization achieves peak gain: 2.9 dBi, phi polarization 3 dB beam width: 74°, phi polarization front-to-back ratio: 3.7 dB. The ground plane with equal length slots in the YZ planar cut phi polarization achieves peak gain: 2.9 dBi, phi polarization 3 dB beam width: 75°, phi polarization front-to-back ratio: 3.7 dB. The ground plane with slots tapered from feed edge to non-feed edge (second tapered slots) in the XZ planar cut phi polarization achieves peak gain: 5.2 dBi, phi polarization 3 dB beam width: 76°, phi polarization front-to-back ratio: 15.8 dB. The ground plane with slots tapered from feed edge to non-feed edge (second tapered slots) in the YZ planar cut phi polarization achieves peak gain: 5.2 dBi, phi polarization 3 dB beam width: 125°, phi polarization front-to-back ratio: 15.8 dB.

Accordingly, the various illustrated embodiments provide an antenna assembly comprising an electrically small patch element positioned above an electrically small ground plane. The electrically small patch element may comprise slots, including straight slots, evenly spaced slots, angled slots, concave slots, convex slots, first tapered slots, second tapered slots or no slots. Additionally, the electrically small ground plane may comprise slots, including straight slots, angled slots, or slots of another design. The antenna assembly can be positioned above a relatively large ground plane without experiencing de-tuning effects such as frequency shift of gain reduction.

It was surprisingly discovered that a slotted electrically small ground plane positioned beneath a patch antenna as described herein effectively minimizes frequency shift between the antenna in free space and when the same is placed on a relatively large ground plane. As such, the antenna assembly can be tuned for a variety of applications, including those with the antenna assembly positioned in free space, and with the antenna assembly positioned on a large ground plane, or any ground plane in between. In this regard, the circuit board or other ground plane of a device for which the antenna assembly may be installed is not significantly relevant to the selection of the antenna assembly, since, the second (large) ground plane will have little to no effect on the antenna assembly with a slotted electrically small first ground plane.

It is proposed herein that the slotted electrically small ground plane acts to shape the radiation pattern and makes the electrically small ground plane act like an electrically large ground plane.

Additionally, it was surprisingly discovered that a slotted parasitic conductor element being positioned over the feed element and electrically small ground plane provides an additional resonance in addition to that created by the antenna patch. The parasitic slots result in a small antenna assembly. Moreover, multiple electrically small parasitic elements can be implemented to produce additional higher resonant frequencies.

It is further proposed that reducing the slots on the antenna assembly can result in a change in polarization of the resulting radiation patterns.

Finally, the slot pattern on the patch element may be designed to achieve a desired front-to-back ratio.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An antenna assembly comprising:

a ground plane having a first longitudinal edge and a second longitudinal edge, the first and second longitudinal edges extending in a longitudinal direction and spaced apart in a lateral direction that is perpendicular to the longitudinal direction, the ground plane defining a first plurality of slots that are open to the first longitudinal edge and a second plurality of slots that are open to the second longitudinal edge; and a patch antenna spaced apart from the ground plane and arranged in parallel with the ground plane, wherein the patch antenna has a pair of opposite edges and defines a first plurality of slots that are open to a first edge of the pair of opposite edges of the patch antenna, wherein the ground plane has a size that is larger than a size of the patch antenna, and wherein each of the first plurality of slots of the ground plane is oriented at an oblique angle relative to the first longitudinal edge of the ground plane or each of the first plurality of slots of the patch antenna is oriented at an oblique angle relative to the first edge of the patch antenna.

2. The antenna assembly of claim 1, wherein at least one of the first plurality of slots of the ground plane or the second plurality of slots of the ground plane is evenly spaced apart.

3. The antenna assembly of claim 1, wherein the slots of the first plurality of slots of the ground plane are arranged in parallel with each other.

4. The antenna assembly of claim 1, wherein each of the slots of the first plurality of slots of the ground plane and each of the slots of the second plurality of slots of the ground plane arranged in parallel with each other.

5. The antenna assembly of claim 1, wherein the pair of opposite edges of the patch antenna are parallel with the longitudinal edges of the ground plane.

6. The antenna assembly of claim 1, wherein the patch antenna defines a second plurality of slots that are open to the other of the of the pair of opposite edges of the patch antenna.

7. The antenna assembly of claim 1, wherein the patch antenna has a feed end, the patch antenna comprising an electrical connection extending towards the ground plane from the feed end.

8. The antenna assembly of claim 7, wherein the patch antenna has a non-feed end opposite the feed end, the non-feed end being free of connection with the ground plane.

9. The antenna assembly of claim 1, further comprising a parasitic element that is spaced apart from the patch antenna and parallel with the patch antenna.

10. The antenna assembly of claim 9, wherein the parasitic element has an edge and defines a plurality of slots that are open to the edge of the parasitic element.

11. The antenna assembly of claim 9, wherein:

the parasitic element has a pair of opposite edges that are parallel with the longitudinal edges of the ground plane;

the parasitic element defines a first plurality of slots that are open to one of the pair of opposite edges of the parasitic element; and the parasitic element defines a second plurality of slots that are open to the other of the pair of opposite edges of the parasitic element.

12. The antenna assembly of claim 1, wherein:

each of the first plurality of slots of the ground plane is oriented at the oblique angle relative to the first longitudinal edge of the ground plane; and each of the first plurality of slots of the patch antenna is oriented perpendicular to the first edge of the pair of opposite edges of the patch antenna.

13. The antenna assembly of claim 12, wherein each of the second plurality of slots of the ground plane is oriented at an oblique angle relative to the second longitudinal edge of the ground plane.

14. The antenna assembly of claim 12, wherein the first plurality of slots of the ground plane comprise at least a first slot having a first length and a second slot having a second length, the second length being different than the first length.

15. The antenna assembly of claim 1, wherein:

each of the first plurality of slots of the ground plane is oriented perpendicular to the first longitudinal edge of the ground plane; and each of the first plurality of slots of the patch antenna is oriented at the oblique angle relative to the first edge of the pair of opposite edges of the patch antenna.

16. The antenna assembly of claim 15, wherein the first plurality of slots of the patch antenna comprise at least a first slot having a first length and a second slot having a second length, the second length being different than the first length.

17. The antenna assembly of claim 15, wherein each of the second plurality of slots of the ground plane is oriented perpendicular to the second longitudinal edge of the ground plane.

18. The antenna assembly of claim 15, wherein the patch antenna defines a second plurality of slots that are open to a second edge of the of the pair of opposite edges of the patch antenna.

19. The antenna assembly of claim 17, wherein each of the second plurality of slots of the patch antenna is oriented at an oblique angle relative to the second edge of the pair of opposite edges of the patch antenna.

* * * * *